US012364376B2

(12) United States Patent
Kang et al.

(10) Patent No.: US 12,364,376 B2
(45) Date of Patent: Jul. 22, 2025

(54) DRUM MODULE FOR CLEANER AND CLEANER INCLUDING THE SAME

(71) Applicant: SAMSUNG ELECTRONICS CO., LTD., Suwon-si (KR)

(72) Inventors: Hun Kang, Suwon-si (KR); Kihwan Kwon, Suwon-si (KR); Kyoungwoung Kim, Suwon-si (KR); Dongjun Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 426 days.

(21) Appl. No.: 17/865,946

(22) Filed: Jul. 15, 2022

(65) Prior Publication Data

US 2023/0090738 A1 Mar. 23, 2023

Related U.S. Application Data

(63) Continuation of application No. PCT/KR2022/008548, filed on Jun. 16, 2022.

(30) Foreign Application Priority Data

Sep. 17, 2021 (KR) ..... 10-2021-0124919

(51) Int. Cl.
*A47L 9/04* (2006.01)
*A46B 9/00* (2006.01)
(Continued)

(52) U.S. Cl.
CPC ..... *A47L 9/0477* (2013.01); *A46B 9/005* (2013.01); *A46B 9/026* (2013.01); *A46B 9/12* (2013.01);
(Continued)

(58) Field of Classification Search
CPC . A47L 9/0477; A47L 5/30; A47L 5/26; A47L 9/0444; A47L 9/0455;
(Continued)

(56) References Cited

U.S. PATENT DOCUMENTS 6,742,220 B2 6/2004 Nagai et al.
7,765,639 B2 8/2010 Lee et al.
(Continued)

FOREIGN PATENT DOCUMENTS

JP 8-173355 7/1996
JP 11-123166 A 5/1999
(Continued)

OTHER PUBLICATIONS

European Search Report dated Sep. 27, 2024 issued in European Application No. EP 22 87 0092.
(Continued)

*Primary Examiner* — Marc Carlson
(74) *Attorney, Agent, or Firm* — STAAS & HALSEY LLP

(57) ABSTRACT

A cleaner includes a main body and a suction head connected to the main body to suck foreign objects into the main body therethrough, the suction head including a housing including a suction port, and a drum module disposed in the housing, and to be rotated to scatter the foreign objects to be sucked through the suction port so that the scattered foreign objects are drawn into the housing through the suction port, and the drum module including a drum body, a first blade coupled to outer circumference of the drum body, a second blade separated from the first blade in a circumferential direction of the drum body and having a mass greater than a mass of the first blade, and a mass compensation member
(Continued)

arranged on the outer circumference of the drum body to compensate for a difference in mass between the first blade and the second blade.

19 Claims, 19 Drawing Sheets

(51) Int. Cl.

| | |
|---|---|
| ***A46B 9/02*** | (2006.01) |
| ***A46B 9/12*** | (2006.01) |
| ***A46B 13/00*** | (2006.01) |
| ***A46B 13/02*** | (2006.01) |
| ***A46D 1/00*** | (2006.01) |
| ***A47L 5/30*** | (2006.01) |

(52) U.S. Cl.
CPC ..... *A46B 13/006* (2013.01); *A46B 13/02* (2013.01); *A46D 1/0207* (2013.01); *A46D 1/0238* (2013.01); *A47L 5/30* (2013.01); *A46B 2200/3033* (2013.01)

(58) Field of Classification Search
CPC ..... A47L 9/0411; A46B 9/005; A46B 9/026; A46B 9/12; A46B 13/006; A46B 13/02; A46B 2200/3033; A46B 13/00; A46D 1/0207; A46D 1/0238
See application file for complete search history.

(56) References Cited

U.S. PATENT DOCUMENTS

| | | | | |
|---|---|---|---|---|
| 8,316,503 | B2 | 11/2012 | Follows et al. | |
| 9,756,998 | B2 * | 9/2017 | Kasper | A47L 9/0411 |
| 10,898,046 | B2 | 1/2021 | Shim et al. | |
| 2017/0150859 | A1 * | 6/2017 | Muir | A47L 9/04 |
| 2021/0113039 | A1 | 4/2021 | Muir | |

FOREIGN PATENT DOCUMENTS

| | | | |
|---|---|---|---|
| JP | 11-318781 | | 11/1999 |
| JP | 2003-325394 | | 11/2003 |
| JP | 2006-158753 | A | 6/2006 |
| JP | 2010-284528 | | 12/2010 |
| KR | 10-2014-0114868 | A | 9/2014 |
| KR | 10-1644887 | | 8/2016 |
| KR | 10-2016-0116047 | A | 10/2016 |
| KR | 10-2020-0045606 | | 5/2020 |

OTHER PUBLICATIONS

International Search Report dated Sep. 30, 2022 issued in PCT Application No. PCT/KR2022/008548.
Written Opinion dated Sep. 30, 2022 issued in PCT Application No. PCT/KR2022/008548.
Office Action dated Jun. 11, 2025 issued in European Application No. EP 22 870 092.8.

* cited by examiner

DRUM MODULE FOR CLEANER AND CLEANER INCLUDING THE SAME

CROSS-REFERENCE TO RELATED APPLICATION(S)

This application a continuation application, under 35 U.S.C. § 111(a), of International Application No. PCT/KR2022/008548, filed Jun. 16, 2022, which is based on claims priority under 35 U.S.C. § 119 to Korean Patent Application No. 10-2021-0124919, filed on Sep. 17, 2021, in the Korean Intellectual Property Office, the disclosures of which are incorporated by reference herein in its entirety.

BACKGROUND

1. Field

The disclosure relates to a drum module for cleaner and a cleaner including the drum module. More specifically, the disclosure relates to a drum module for cleaner including a mass compensation member for matching a mass center and a rotation center, and a cleaner including the drum module.

2. Descriptions of Related Art

Cleaners are machines for removing dirt to clean the room, and vacuum cleaners are often used in many households. The vacuum cleaner cleans the room by sucking up air with suction force of a fan motor and separating dirt in the air through a device such as a filter. There are canister type and upright type vacuum cleaners, and robot cleaners that perform cleaning while autonomously moving around and sucking up dirt from surfaces to be cleaned without manipulation of the user are becoming popular these days.

The cleaner may include a suction head that is a part contacting the surface to be cleaned to directly suck up foreign materials. The suction head may include a drum module for swiping or striking the surface to be cleaned to scatter the foreign materials, thereby separating the foreign materials from the surface to be cleaned and thus increasing cleaning efficiency. The drum module may include a blade that directly swipes or strikes the surface to be cleaned.

The surface to be cleaned may have many different conditions. In some cases, the surface to be cleaned may be a hard floor or have a carpet-like condition. In order for the drum module to better scatter foreign materials in many different conditions, various kinds of blades may be used.

In the case of using the various kinds of blades, a mass center of the drum module may not be matched with a rotation center, so there may be a need for a member for compensating for this.

SUMMARY

The disclosure provides a drum module having its mass center matched with its rotation center to reduce noise, and a cleaner including the drum module.

The disclosure also provides a drum module having its mass center matched with its rotation center to reduce vibration, and a cleaner including the drum module.

According to an aspect of the disclosure, a cleaner includes a main body, and a suction head connected to the main body to suck foreign objects into the main body therethrough, the suction head may include a housing including a suction port, and a drum module disposed in the housing, and to be rotated to scatter the foreign objects and to be sucked through the suction port so that the scattered foreign objects are drawn into the housing through the suction port the drum module may include a drum body, a first blade coupled to outer circumference of the drum body, a second blade separated from the first blade in a circumferential direction of the drum body and having a mass greater than the first blade, and a mass compensation member arranged on the outer circumference of the drum body to compensate for a difference in mass between the first blade and the second blade to reduce vibration and noise.

The second blade may have hardness greater than hardness of the first blade.

The mass compensation member may include a mass compensation rib extending in a longitudinal direction of the first blade.

The mass compensation rib may be formed to have length corresponding to the length of the first blade.

The mass compensation rib may be located to be adjacent to the first blade.

The drum body may include a supporting rib having an accommodation space to accommodate the first blade, and the mass compensation rib may be located to contact the supporting rib.

The first blade may include a brush made of nylon, and the second blade may include a rubber material.

The mass compensation member may have a mass to compensate the difference in mass between the first blade and the second blade so as to make a mass center of the drum module closer to a rotation center of the drum module.

The first blade may be formed in a spiral shape along an outer circumferential surface of the drum body, and the mass compensation rib may be formed in a spiral shape on the outer circumference of the drum body along the first blade.

The second blade may protrude further than the first blade in a radial direction of the drum body.

The mass compensation member may include a first mass compensation rib located to be adjacent to the first blade, and the drum module may further include a third blade separated from the first blade and the second blade in the circumferential direction of the drum body and having a mass less than a mass of the second blade, and a second mass compensation rib located to be adjacent to the third blade.

The drum module may further include a third blade configured to be separated from the first blade and the second blade in the circumferential direction of the drum body and having a mass less than a mass of the second blade, a first supporting rib arranged to correspond to a location of the first blade to accommodate the first blade, a second supporting rib arranged to correspond to a location of the second blade to accommodate the second blade, and a third supporting rib arranged to correspond to a location of the third blade to accommodate the third blade, the mass compensation member may be a mass compensation rib extending in a longitudinal direction of the blade, and the mass compensation rib may further include a first mass compensation rib located between the first supporting rib and the second supporting rib and formed to be nearer to the first supporting rib in the circumferential direction, and a second mass compensation rib located between the second supporting rib and the third supporting rib and formed to be nearer to the third supporting rib in the circumferential direction.

The drum module may further include a third blade configured to be separated from the first blade and the second blade in the circumferential direction of the drum body and having a mass less than a mass of the second blade, a first supporting rib arranged to correspond to a location of the first blade to accommodate the first blade, a second supporting rib arranged to correspond to a location of the second blade to accommodate the second blade, and a third supporting rib arranged to correspond to a location of the third blade to accommodate the third blade, the mass compensation member may be a mass compensation rib extending in a longitudinal direction of the blade and located between the first supporting rib and the third supporting rib.

The drum body may include a first thickness portion having first thickness, and the mass compensation rib may be a second thickness portion integrally formed with the drum body and having greater thickness than the first thickness portion.

The drum module may further include a third blade with a mass less than the mass of the first blade and the mass of the second blade, the mass compensation member may be a mass compensation rib extending in a longitudinal direction of the blade, and the mass compensation rib may include a first mass compensation rib located to be adjacent to the first blade, and a second mass compensation rib located to be adjacent to the third blade and having a mass greater than the first mass compensation rib.

According to another embodiment of the disclosure, a cleaner includes a main body, and a suction head connected to the main body to suck foreign objects into the main body, the suction head may include a housing having a suction port through which the foreign object is sucked into, and a drum module rotationally coupled to the housing to scatter the foreign objects to be sucked through the suction port so that the scattered foreign objects are drawn into the housing, and the drum module may include a drum body defining external appearance, a first blade coupled to an outer circumferential surface of the drum body to contact and scatter the foreign objects, a second blade separated from the first blade in a circumferential direction of the drum body, and having a higher density than a density of the first blade, and a mass compensation rib arranged to be adjacent to the first blade to make a mass center of the drum module closer to a rotation center to reduce vibration and noise.

The mass compensation rib may have a mass as much as a difference in mass between the first blade and the second blade and extend in a longitudinal direction to make a mass center of the drum module closer to a rotation center of the drum module.

The mass compensation rib may have a square-shaped cross-section.

According to another embodiment of the disclosure, a drum module for cleaner includes a drum body, and a blade coupled to an outer circumferential surface of the drum body, the blade may include a first blade and a second blade having a greater mass than the first blade, and a mass compensation member arranged on the outer circumferential surface to make a mass center of the drum module closer to a rotation center of the drum module.

The mass compensation member may be a mass compensation rib extending in a longitudinal direction of the blade and having length corresponding to a length of the first blade.

According to the present disclosure, by adding a member for compensating for the mass eccentricity in the drum module, the center of mass of the drum module is matched with the center of rotation, thus reducing noise and vibration of the drum module and a cleaner including the same.

According to the present disclosure, by changing the material and shape of the blade to compensate for the mass eccentricity in the drum module, the center of mass is matched with the center of rotation of the drum module, thus reducing the noise and vibration of the drum module and a cleaner including the same.

DETAILED DESCRIPTION

Figure 1:
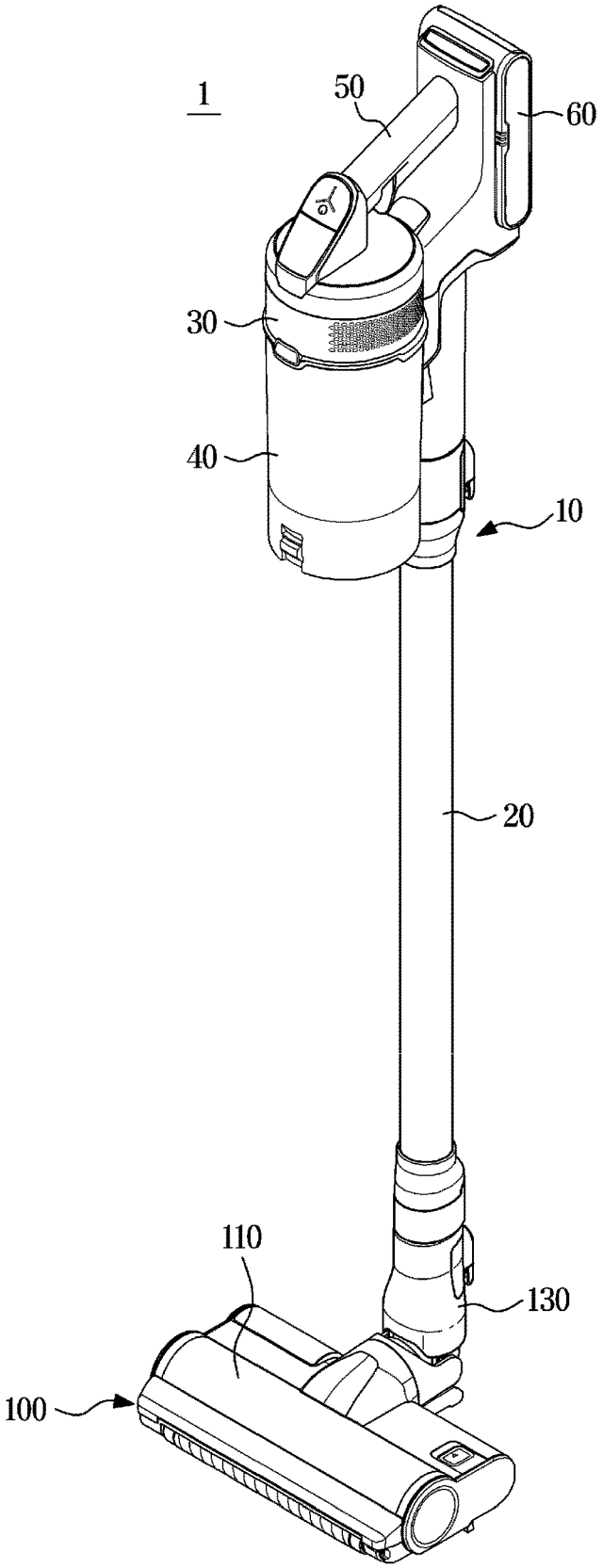
FIG. 1 is a perspective view illustrating an exterior of a cleaner, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "up-down direction", "lower side" and "front-back direction" as herein used are defined with respect to the drawings, but the terms may not restrict the shape and position of the respective components.

Where a suction head 100 is arranged in FIG. 1 may be defined as front and where a handle 50 is arranged may be defined as back. In other words, it may be defined that air is brought in at the front of a cleaner 1 and discharged to the back. Shapes and positions of respective components are not, however, limited by the terms defined as described above.

FIG. 1 is a perspective view illustrating an exterior of the cleaner 1, according to an embodiment of the disclosure.

As shown in FIG. 1, the cleaner 1 may include a main body 10, the suction head 100, and an extension tube 20 connecting between the main body 10 and the suction head 100.

The main body 10 may include a suction force generator 30 for generating suction force, a foreign material collecting chamber 40 for separating and collecting foreign materials from air sucked up, the handle 50, and a battery 60 for supplying power to the suction force generator 30.

The suction force generator 30 may include a motor (not shown) for converting electric power to mechanical rotational power and a fan (not shown) coupled to the motor to be rotated. The foreign material collecting chamber 40 may collect foreign materials in a cyclonic method of using centrifugal force to separate the foreign materials or in a dirtback method of separating the foreign materials by forcing air to pass through a filter bag. The air from which the foreign materials are removed through the foreign material collecting chamber 40 may be discharged out of the main body 10.

The extension tube 20 may be formed as a flexible hose or a pipe having certain hardness. The extension tube 20 may deliver suction force generated by the suction force generator 30 to the suction head 100, and guide air and foreign materials sucked up through the suction head 100 to the main body 10.

The suction head 100 may include a housing 110 that defines external appearance. The suction head 100 may include a suction connector 130 coupled to the extension tube 20. The suction head 100 may be rotationally coupled to the extension tube 20 through a suction connector 130. The suction head 100 may closely contact a surface to be cleaned and suck up air and foreign materials on the surface to be cleaned.

Figure 2:
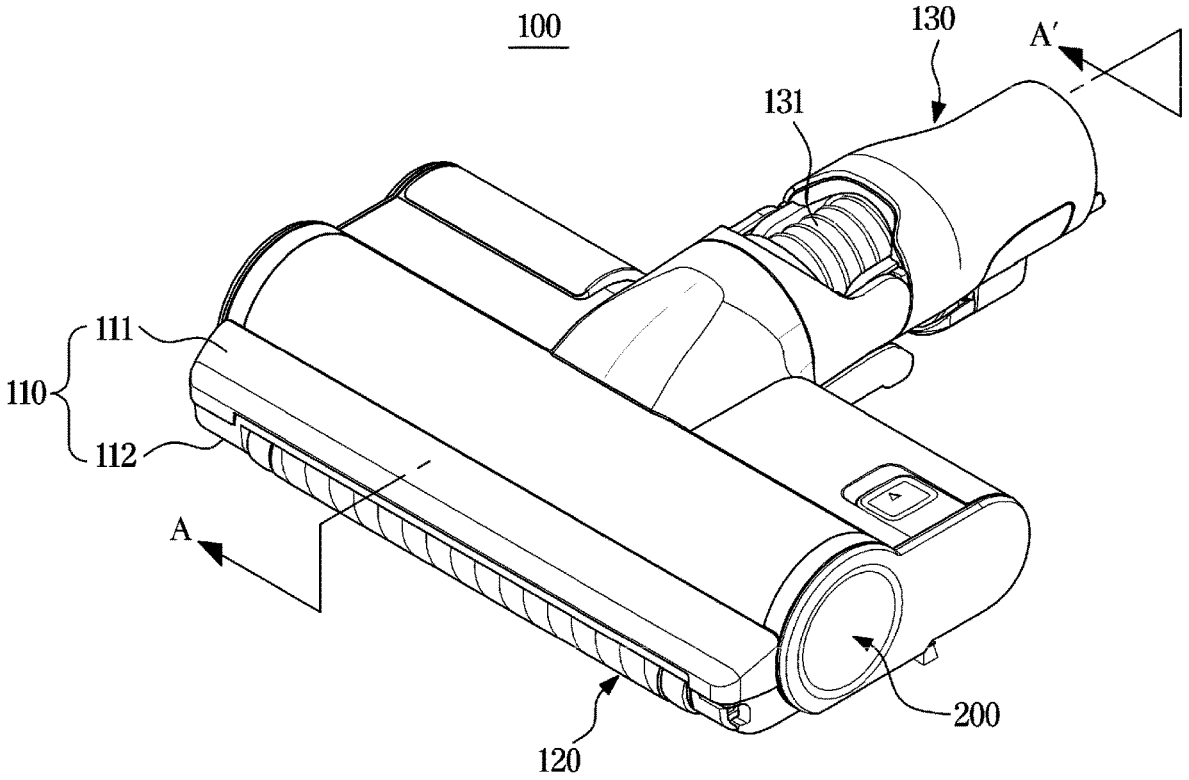
FIG. 2 is a perspective view illustrating an exterior of a suction head of the cleaner of FIG. 1.

FIG. 2 is a perspective view illustrating an exterior of the suction head 100 of the cleaner 1 of FIG. 1.

As shown in FIG. 2, the suction head 100 may include the housing 110 that defines the external appearance. The housing 110 may include an upper housing 111 located upward and a lower housing 112 coupled at a lower end of the upper housing 111. A space to accommodate various parts may be provided between the upper housing 111 and the lower housing 112.

A roller 120 may be accommodated in a front inner space of the housing 110. The roller 120 may draw foreign materials into the housing 110 while being rotated.

Figure 3:
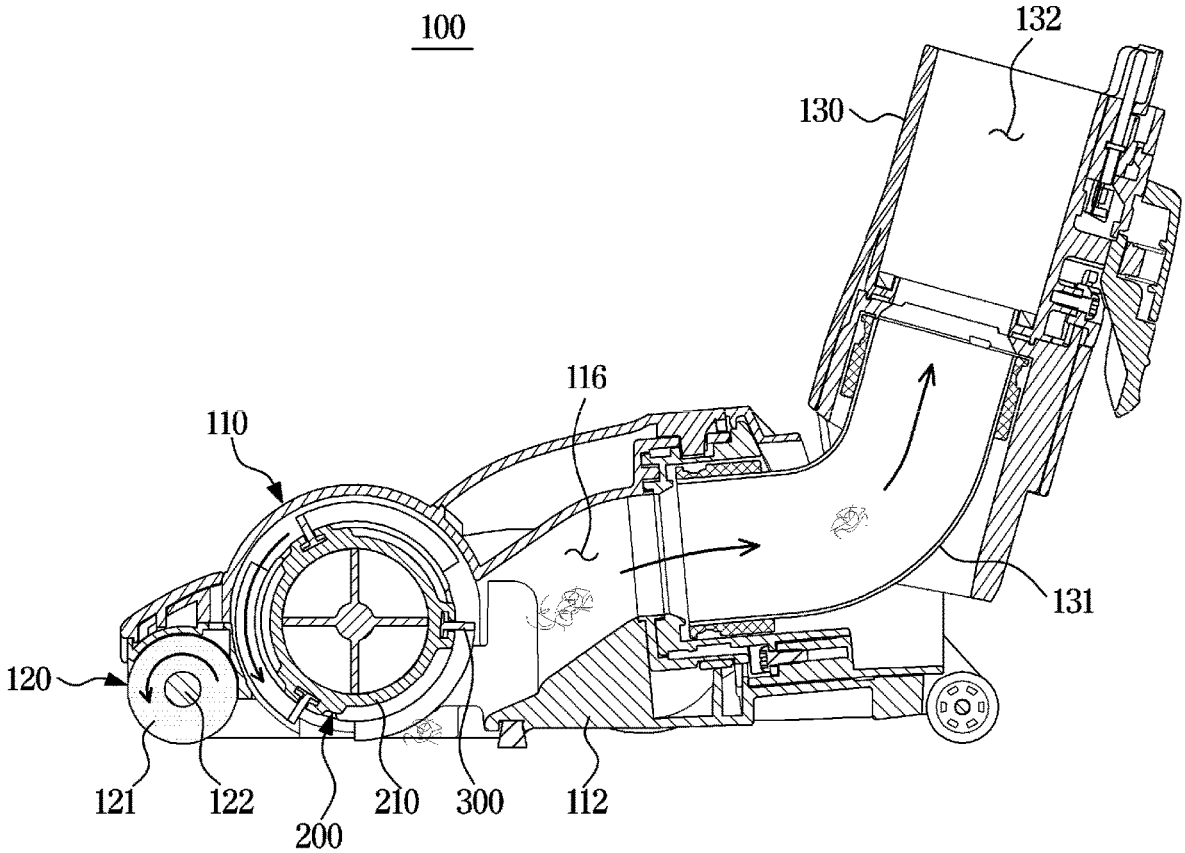
FIG. 3 is a cross-sectional view of the suction head of FIG. 2 which is cut along AA'.

A drum module 200 may be accommodated in the internal space of the housing 110. As shown in FIG. 3, the drum module 200 may scatter foreign materials on the surface to be cleaned.

The suction connector 130 may be connected at the rear of the housing 110. Where the suction connector 130 and the housing 110 are connected may be bent. The suction connector 130 may include a flexible tube 131 formed of a soft material such that foreign materials move to the connection tube without leaking out even with the bent portion.

FIG. 3 is a cross-sectional view of the suction head 100 of FIG. 2 which is cut along AA'.

As shown in FIG. 3, the suction head 100 may include the roller 120 at the front. The roller 120 may include a foreign material contactor 121 that constitutes an outer surface of the roller 120. The roller 120 may be located inside the foreign material contactor 121 and may include a roller shaft 122 that becomes an axis around which the foreign material contactor 121 is rotated.

The foreign material contactor 121 may touch foreign materials present on the surface to be cleaned and draw the foreign materials into the housing 110. The foreign material contactor 121 may include a highly deformable material.

In a case that the foreign material contactor 121 is formed with a low deformable material, the foreign material contactor might not draw relatively large-sized foreign materials into the housing 110. It is because the foreign materials may not be moved along with rotation of the foreign material contactor 121 even when the roller 120 is rotated and the foreign material contactor 121 touches the foreign materials. On the contrary, with a highly deformable material, the foreign material contactor 121 may be able to touch and draw even relatively large-sized foreign materials into the housing 110 along with rotation of the roller 120.

Based on the same principle, the foreign material contactor 121 may include a highly adhesive material.

The suction head 100 may include the drum module 200 in the housing 110. The drum module 200 may include a drum body 210 that constitutes the external appearance. The drum module 200 may include a blade 300 coupled onto the outer circumference of the drum body 210 and protruding in a radial direction.

The drum module 200 may be rotated. As the drum body 210 of the drum module 200 rotates, the blade 300 coupled to the outer circumferential surface may rotate as well. The blade 300 may strike the surface to be cleaned while being rotated. This may scatter foreign materials present on the surface to be cleaned. In a case that the foreign materials are not scattered, since the foreign materials are adhered to the surface to be cleaned, so the efficiency of cleaning may be low. On the contrary, when the foreign materials are scattered and separated from the surface to be cleaned, the foreign materials may be better sucked into the housing 110 and thus, the cleaning efficiency may increase.

The foreign materials scattered by the drum module 200 may be drawn into the inner housing space 116, passing the flexible tube 131 and moving into internal suction connector space 132.

Figure 4:
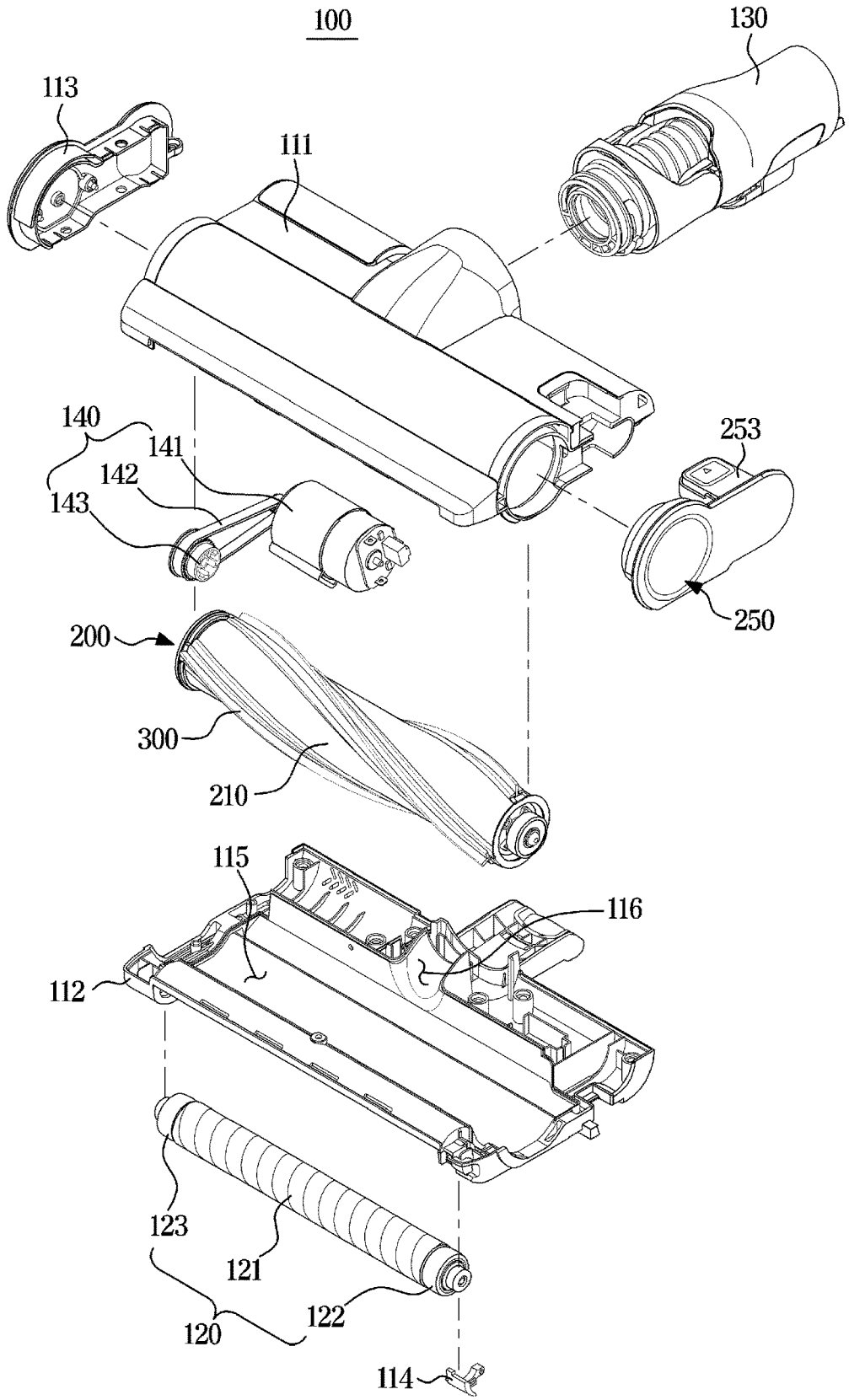
FIG. 4 is an exploded perspective view of the suction head of FIG. 2.

FIG. 4 is an exploded perspective view of the suction head 100 of FIG. 2.

As shown in FIG. 4, the suction head 100 may include various components.

The housing 110 (see FIG. 1) of the suction head 100 may include the upper housing 111 that constitutes an upper exterior, the lower housing 112 coupled onto a lower side of the upper housing 111, forming a lower exterior and including a suction port 115, and a side housing 113 coupled onto one sides of the upper housing 111 and the lower housing 112 to form a side exterior.

The suction head 100 may include the drum module 200 located in the housing 110. As the drum module 200 scatters foreign materials to be drawn into the inner housing space 116, the drum module 200 may be located on the side of the suction port 115 in the housing 110.

The drum module 200 may include the drum body 210 that constitutes the external appearance and the blade 300 extending in the radial direction and striking foreign materials.

The drum body 210 may be shaped like a cylinder with empty space formed along the rotation shaft.

The blade 300 may be arranged in a spiral form along the outer circumferential surface of the drum body 210. Thus, foreign materials may be better drawn into the housing 110.

The drum module 200 may further include a side cap 250 formed on one side of the drum body 210. The side cap 250 may avoid trouble in driving the drum body 210 by preventing foreign materials from entering into the drum body 210.

The side cap 250 may include a button 253 to allow the drum body 210 to be separated from the housing 110.

Although the drum body 210 and the side cap 250 are shown as being separated in FIG. 4, the drum body 210 and the side cap 250 may be integrally formed.

The suction head 100 may include a power part 140 to rotate the drum module 200. The power part 140 may include a motor 141 located in the housing 110 to generate power. The power part 140 may include a motor bearing 143 located on one side of the drum body 210 to be coupled to the rotation shaft. The power part 140 may include a pulley 140 having one end coupled to the motor bearing 143 and the other end coupled to the rotation shaft of the motor 141 to deliver power of the motor 141 to the drum body 210.

With this, when the motor 141 generates power and the rotation shaft of the motor 141 is rotated, the pulley 142 is rotated, making the bearing of the motor 141 rotated and thus, making the drum body 210 connected to the motor bearing 143 rotated.

The suction head 100 may include the roller 120 located at the front in the housing 110. The roller 120 may include the foreign material contactor 121 that forms the external appearance, the roller shaft 122 located in the foreign material contactor 121 and forming the rotation axis, and a wheel module 123 coupled to the roller shaft 122 to guide rotation of the roller shaft 122. The roller 120 may draw foreign materials into the housing 110 at the front of the suction head 100.

In order for the roller 120 to be coupled to the inside of the housing 110 or to be easily decoupled therefrom, the housing 110 may include a separable roller coupling member 114 at where the wheel module 123 of the roller 120 is arranged.

Figure 5:
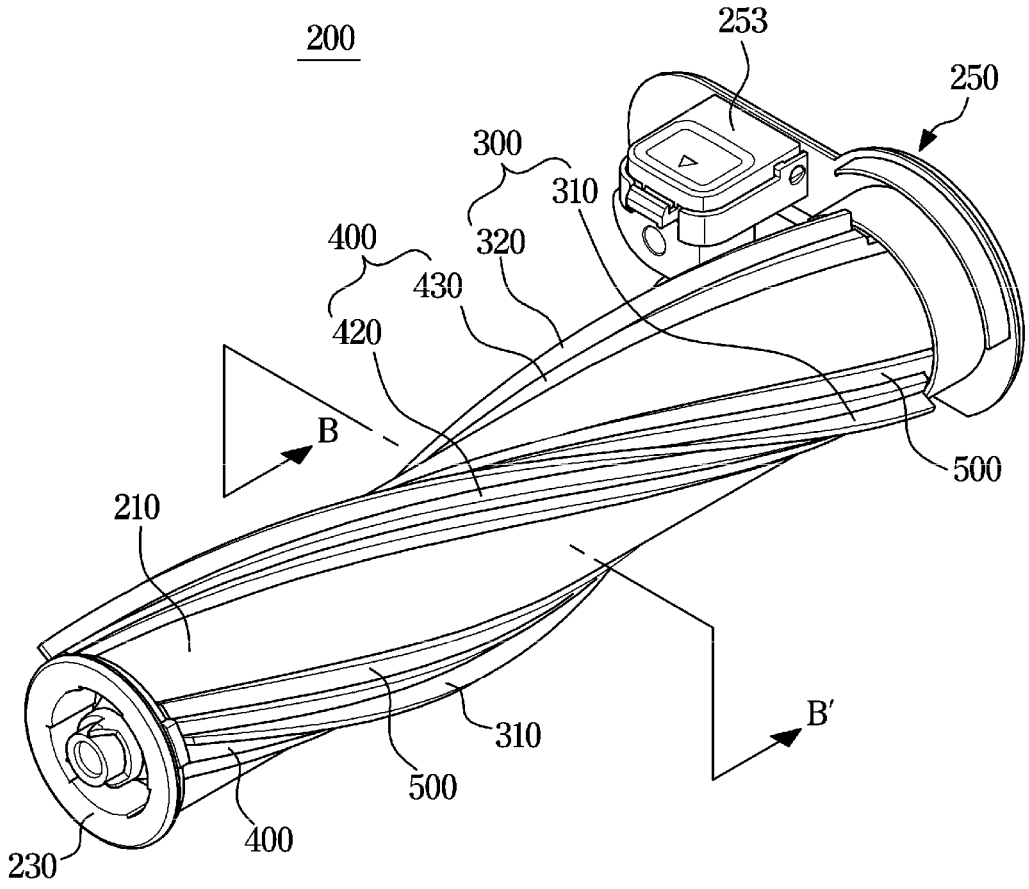
FIG. 5 is a perspective view of a drum module of the suction head of FIG. 4.

FIG. 5 is a perspective view illustrating the drum module 200 of the suction head 100 of FIG. 4.

As shown in FIG. 5, the blade 300 may be located on the outer circumference of the drum body 210 included in a drum module 200. As explained earlier, as the drum body 210 rotates, the blade 300 rotates and the rotating blade 300 may scatter foreign materials on the surface to be cleaned. When the foreign materials are separated from the surface to be cleaned, the foreign materials may be easily sucked into the housing 110.

The blade 300 may include a first blade 310 and a second blade 320 having a different mass from the first blade 310.

The blade 300 may include a soft material with low hardness. For example, the blade 300 may include a nylon brush. Since the blade formed with a material having low hardness may sweep up foreign materials, so the blade may play an adequate role of scattering foreign materials on a hard floor.

However, in a case that the cleaner 1 is used in a cleaning environment in which foreign materials come into close contact with a carpet-like surface to be cleaned, the blade 300 with low hardness may have low cleaning efficiency. It is because the blade 300 with low hardness fails to give enough impact to scatter the foreign materials in surfaces to be cleaned. In this case, when the blade 300 with high hardness is used, the blade 300 may have adequate cleaning efficiency.

However, in a case that all the blades 300 having high hardness are used, cleaning efficiency may decrease again on the floor. Furthermore, the blade 300 with high hardness may give a heavy load to the motor 141 of the cleaner 1 as much as the blade 300 applies great force to the floor.

To solve this problem, a mixture of high rigid blade 300 and low rigid blade 300 may be used.

Accordingly, the blade 300 may include the first blade 310 and the second blade 320 having different hardness from the first blade 310. The second blade 320 has different hardness from the first blade 310, so the second blade 320 may have a different mass from the first blade 310 as well.

Materials with different hardness may generally have different masses. Accordingly, using blades with different hardness together may mean that blades with different masses may be used. Based on this, the first blade 310 and the second blade 320 may have different masses.

The first blade 310 may be a nylon brush. With the nylon brush used for the first blade 310, the first blade 310 may serve to swipe up foreign materials while being rotated.

The second blade 320 may be formed with a rubber material. With the rubber material used for the second blade 320, the second blade 320 may strike the surface to be cleaned while being rotated. The second blade 320 may be required when there is a need to scatter foreign materials stuck deeply in the surface to be cleaned.

Hence, the first blade 310 may have a mass less than the second blade 320. However, the first blade 310 and the second blade 320 are not limited to having the aforementioned materials. When the first blade 310 and the second blade 320 have required hardness, the first blade 310 and the second blade 320 may include corresponding materials.

However, it is an example, and the first blade 310 and the second blade 320 may have different masses for another reason, such as having the first blade 310 and the second blade 320 in different volumes. However, for convenience of explanation, an occasion of having different hardness will now be assumed in the following description.

The drum module 200 may include a supporting rib 400 formed on the outer circumference of the drum body 210. The supporting rib 400 may be arranged to protrude in the radial direction of the drum body 210. An accommodation space 410 may be formed inside the supporting rib 400. The blade 300 may be accommodated in the accommodation space 410 of the supporting rib 400. The blade 300 may be supported by the supporting rib 400 and coupled onto the outer surface of the drum body 210.

The blade 300 may be provided in a spiral form, and the supporting rib 400 supporting the blade 300 may also be provided in the spiral form. Having the shape matching the blade 300, the supporting rib 400 may evenly support the blade 300 in a longitudinal direction of the blade 300.

In this case, the supporting rib 400 supporting the first blade 310 may be referred to as a first supporting rib 420 and the supporting rib 400 supporting the second blade 320 may be referred to as a second supporting rib 430.

Meanwhile, when there are a small number of blades 300, the angle at which each of the blades 300 is twisted into the spiral form may be large, causing an increase in scattering foreign materials. In this case, however, a high load may be applied to the motor 141 while the floor is struck. On the other hand, the more the number of the blades 300, the lower the load applied to the motor 141. However, the angle twisted into the spiral form decreases so that the cleaning efficiency may decrease.

Accordingly, the different number of blades 300 may be set depending on power of the motor 141 and a condition of the floor.

The second blade 320 having a rubber material may effectively scatter foreign materials on an occasion when the foreign materials are stuck deeply in a carpet-like surface to be cleaned, but may apply as high a load to the motor as the surface to be cleaned is strongly struck. When there is a load to the motor, the motor power may be weaker than there is no load to the motor. Hence, increasing the number of the second blades 320 may make it possible to effectively touch up to the surface to be cleaned where foreign materials are stuck, but may reduce the motor power, thereby weakening force to strike the foreign materials. Taking this into account, the drum module 200 may include an appropriate number of first and second blades 310 and 320.

Furthermore, when the cleaner 1 is used more often in a non-carpet-like condition than in a carpet-like condition, the number of the first blades 310 may be greater than the number of the second blades 320.

To apply the idea of the disclosure, the first blade 310 and the second blade 320 may be provided one for each, or there may be two first blades 310 and one second blade 320. The number of the blades 300 is not limited in the disclosure. However, for convenience of explanation, an occasion when there are two first blades 310 and one second blade 320 is assumed in the following description.

The first blade 310 and the second blade 320 may be arranged at the same intervals. It is not, however, limited thereto, and the first blade 310 and the second blade 320 may be arranged at different intervals.

In the occasion when there are two first blades 310 and one second blade 320, which are arranged at regular intervals, there is a difference in mass between the first blade 310 and the second blade 320, so the rotation center of the drum module 200 may not correspond to the mass center. In this case, the cleaner 1 may make vibrations and noise. Hence, a structure for solving this may be required. As the first blade 310 and the second blade 320 may differ in mass, the drum module 200 may include a mass compensation member 500 to deal with mass eccentricity by compensating for the difference in mass. The mass compensation member 500 will be described in more detail with reference to the drawings from FIG. 7.

Figure 6:
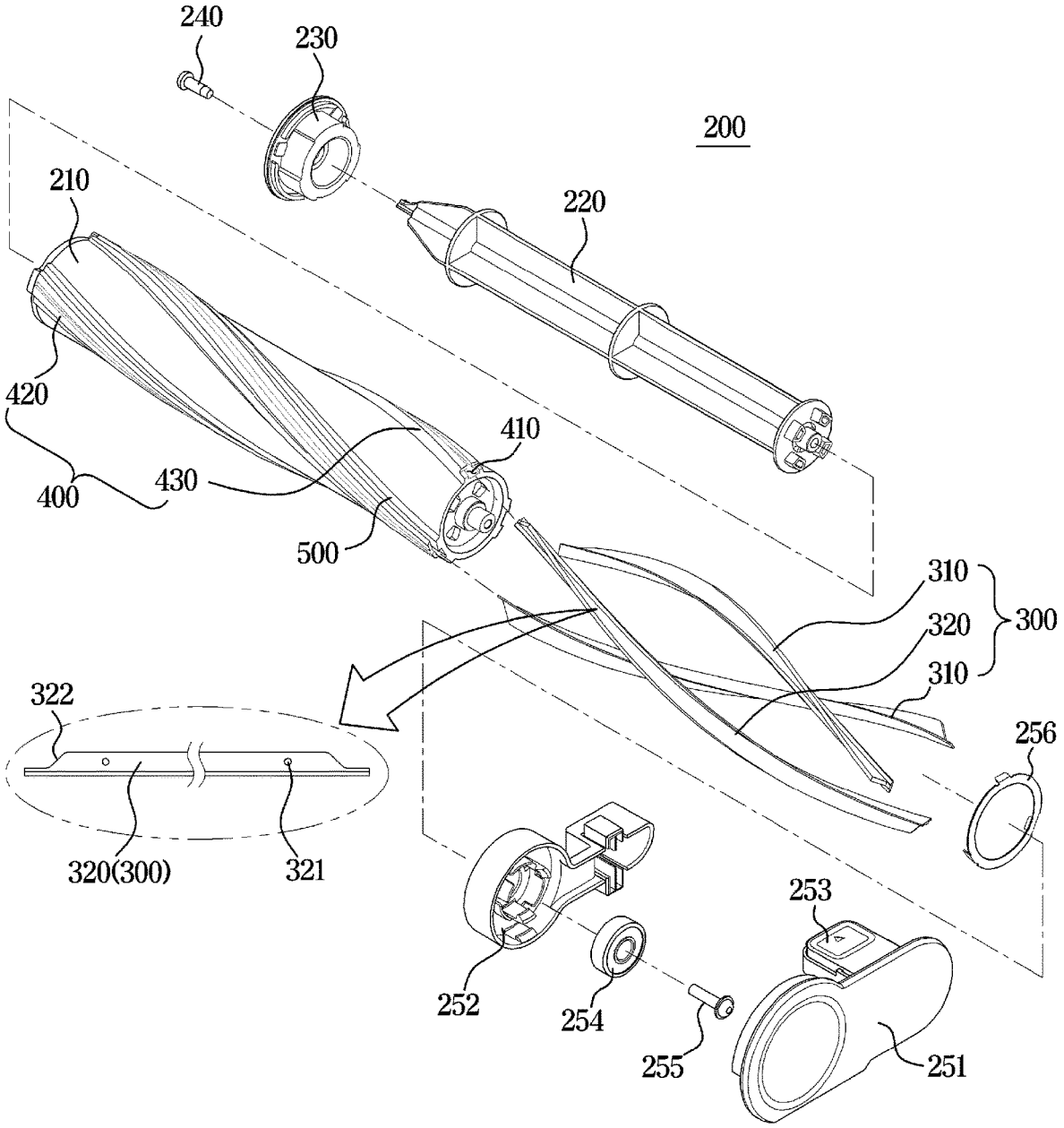
FIG. 6 is an exploded perspective view of the drum module of FIG. 5.

FIG. 6 is an exploded perspective view of the drum module 200 of FIG. 5.

As shown in FIG. 6, the drum module 200 may include various components.

An inner drum body 220 may be located inside the drum body 210 included in the drum module 200. The inner drum body 220 may be coupled to the bearing of the motor 141 by a first coupling member at an end. Accordingly, the power delivered from the bearing of the motor 141 is, to be precise, delivered to the inner drum body 220, and to the drum body 210 because the inner drum body 220 and the drum body 210 are coupled to each other.

A drum fixing member 230 may be located between the inner drum body 220 and the first coupling member 240 and located at a side of the drum body 210 to prevent foreign materials from entering into the drum body 210.

As examined earlier, the blade 300 may be coupled onto the outer circumferential surface of the drum body 210 by the supporting rib 400 arranged in a corresponding position.

The blade 300 may include a hole 321. The hole 321 may create a flow, making the foreign materials better scattered while the blade 300 is rotated.

For convenience of explanation, it is assumed that the hole 321 is formed on the second blade 320 in the following description. It is not, however, limited thereto, the hole 321 formed on the first blade 310 may also fall within the scope of the disclosure.

The blade 300 may include an inclined plane 322 at either end. When the blade 300 is heavy, a heavier load may be applied to the motor 141 that rotates the blade 300. In this case, when the inclined plane 322 formed at either end of the blade 300 reduces weight of the blade 300, the load to be applied to the motor 141 may be reduced.

For convenience of explanation, it is assumed that the inclined planes 322 are formed on the second blade 320 in the following description. It is not, however, limited thereto, the inclined planes 322 formed on the first blade 310 may also fall within the scope of the disclosure.

The side cap 250 may be located on the other end of the drum body 210 where the drum fixing member 230 is not coupled. The side cap 250 may include an inner side cap 252 located on the side of the drum body 210 and an outer side cap 251 coupled to the inner side cap 252. The side cap 250 may include a cap bearing 254 located in a space formed between the inner side cap 252 and the outer side cap 251. The cap bearing 254 may be coupled to the rotation shaft of the drum body 210 by a second coupling member 255, so the cap bearing 254 may guide rotation of the drum body 210.

The drum module 200 may include a sealing member 256 located between the side cap 250 and the drum body 210. The sealing member 256 may have a form of a cross-section of the drum module 200. The sealing member 256 may prevent foreign materials from entering to the inside of the drum body 210 or into the side cap 250 when the drum body 210 is rotated.

Figure 7:
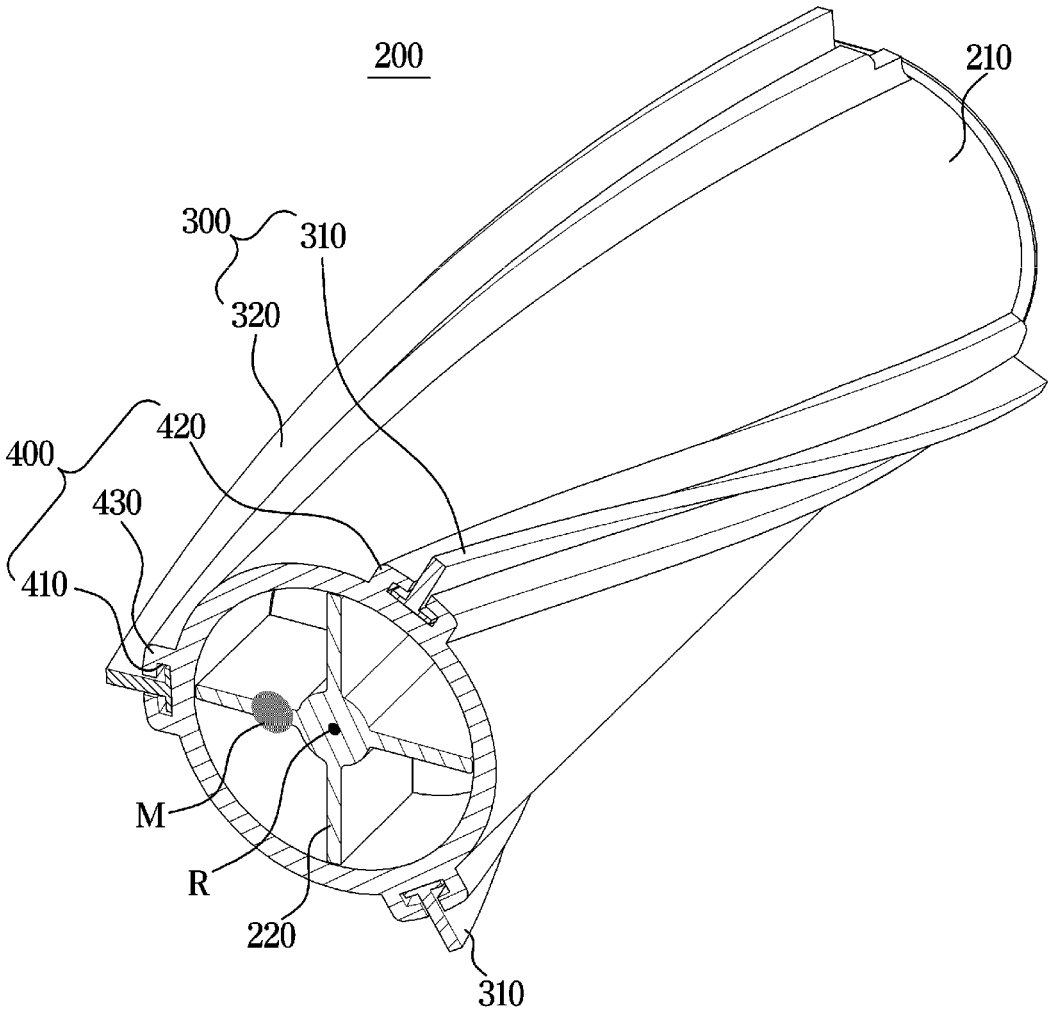
FIG. 7 is a cross-sectional view of the drum module with no mass compensation member added thereto, which is cut along BB'.
Figure 8:
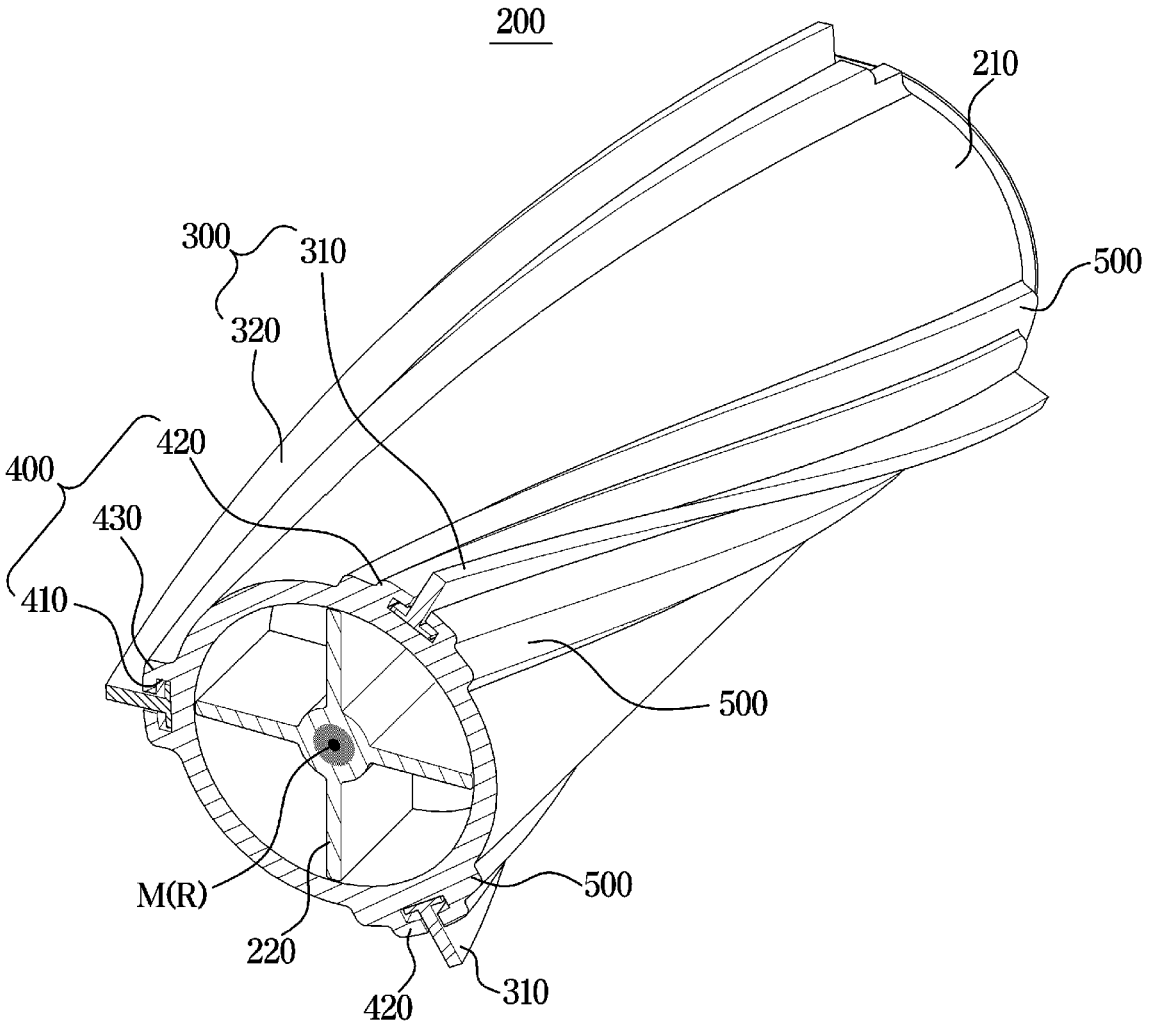
FIG. 8 is a cross-sectional view of the drum module with a mass compensation member added thereto, which is cut along BB'.

FIGS. 7 and 8 illustrate a mass center M and a rotation center R.

FIG. 7 is a cross-sectional view of the drum module 200 without the mass compensation member 500 added thereto, which is cut along BB'.

As shown in FIG. 7, the first blade 310 may be a nylon brush, and the second blade 320 may be of a rubber material. With this, the first blade 310 and the second blade 320 may differ in mass, and the second blade 320 may be heavier than the first blade 310, so the mass center M may lean to the side of the second blade 320. The rotation center R of the drum module 200 is located on the rotation shaft, which is a geometric center. Accordingly, the rotation center R of the drum module 200 and the mass center M may be in different locations. Hence, the drum module 200 may make vibration and noise while being rotated.

FIG. 8 is a cross-sectional view of the drum module 200 with the mass compensation member 500 added thereto, which is cut along BB'.

As shown in FIG. 8, when the drum module 200 includes the mass compensation rib 500, the mass center M is made closer to the rotation center R. Preferably, the mass center M is matched with the rotation center R.

In this case, the mass compensation member 500 may be a mass compensation rib 500 extending in a longitudinal direction of the first blade 310. Hence, the difference in mass between the first blade 310 and the second blade 320 may be compensated for at every point.

For convenience of explanation, it is assumed that the mass compensation member 500 corresponds to the mass compensation rib 500 in the following description. It is not, however, limited to the shape of the rib.

The mass compensation rib 500 may be formed to have length corresponding to the length of the first blade 310. Hence, to compensate for a difference in mass at every point, the level of difficulty in forming the mass compensation rib 500 may be lowered.

Figure 9:
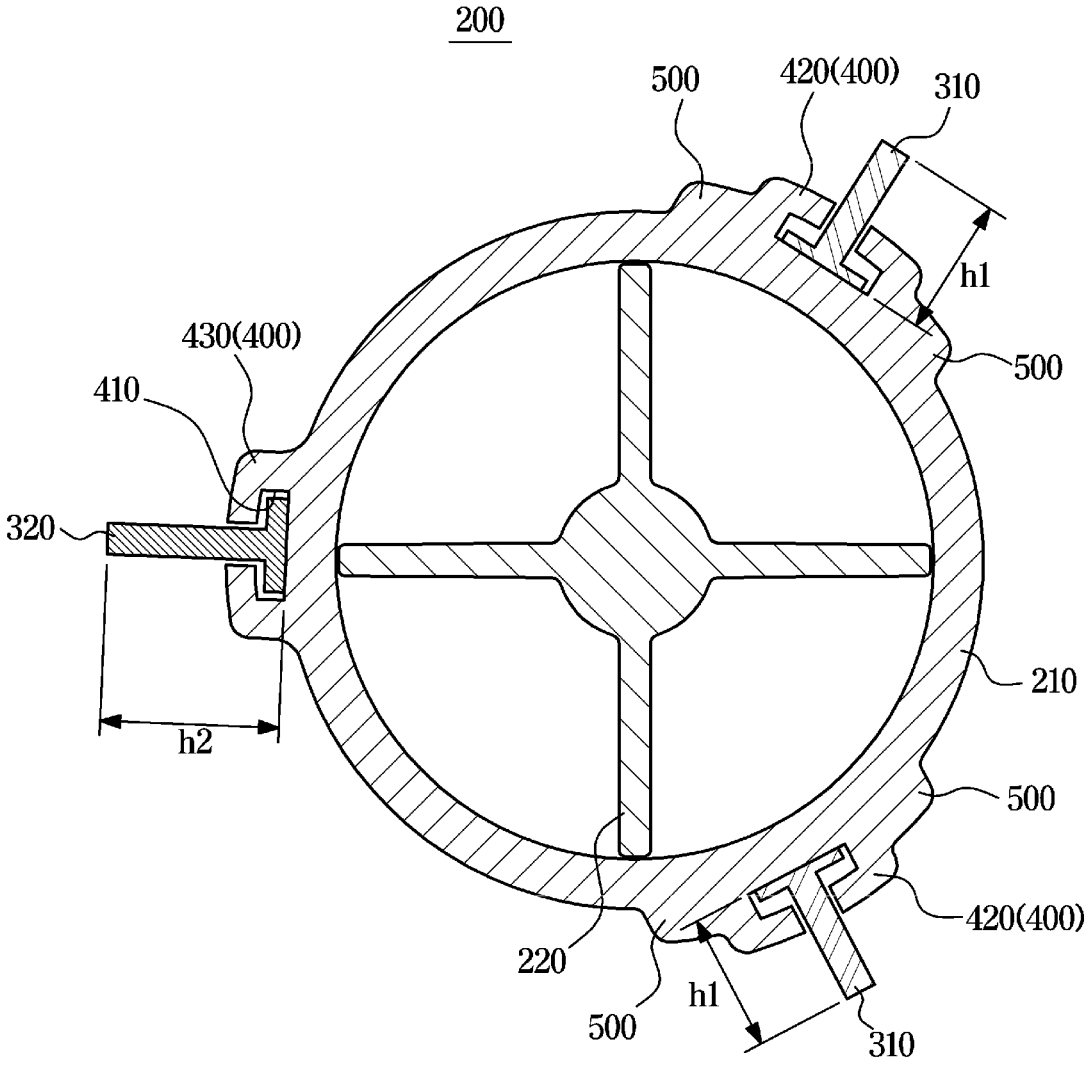
FIG. 9 is another cross-sectional view of the drum module of FIG. 5 which is cut along BB'.

FIG. 9 is another cross-sectional view of the drum module 200 of FIG. 5 which is cut along BB'.

As shown in FIG. 9, the mass compensation rib 500 may be located to be adjacent to the first blade 310. A mass of the second blade 320 itself is larger than a mass of the first blade 310, causing mass eccentricity, so it may be effective to form the mass compensation rib 500 on the first blade 310. However, it is difficult to form the mass compensation rib 500 on the first blade 310 in reality, so forming the mass compensation rib 500 as close to the first blade 310 as possible may be most suitable to attain the same effect.

As the first blade 310 may be formed by being accommodated in the accommodation space 410 of the first supporting rib 420, the mass compensation rib 500 needs to be located adjacent to the first supporting rib 420 to be closest to the first blade 310.

The mass compensation rib 500 may have a rigid body separated to be attachable to the drum body 210. However, the mass compensation rib 500 may be integrally formed with the drum body 210. Having the drum body 210 and the mass compensation rib 500 formed integrally may be implemented by a single process, so the structure has the merit of reducing manufacturing costs.

The mass compensation rib 500 may be formed to have a mass as much as or similar to a difference in mass between the first blade 310 and the second blade 320.

As the mass center M may be calculated in the following equation, the mass center M may be matched with the rotation center R when the mass compensation rib has as much a mass as the difference in mass between the first blade 310 and the second blade 320.

$$Xcm=(m1x1+m2x2+m3x3)/m1+m2+m3$$

$$Ycm=(m1y1+m2y2+m3y3)/m1+m2+m3$$

The second blade 320 may have higher hardness than the first blade 310, and may be formed to protrude further in the radial direction of the drum body than the first blade 310 to have efficient cleaning performance on an occasion when foreign materials hardly come out from a carpet-like surface to be cleaned. In the case of the carpet-like surface in which foreign materials are stuck deep, the foreign materials may be located deeper than the surface. Hence, the second blade 320 to strike the foreign materials located deeper than the surface may have higher height than that of the first blade 310 to strike the surface. The height of the first blade 310 may be called first height h1, and the height of the second blade 320 may be called second height h2. The second height h2 may be set to be higher than the first height h1. The second blade 320 is able to strike the foreign materials in a cleaning environment where the foreign materials are stuck deep in the carpet-like surface to be cleaned only when the height h2 is higher than the height h1 of the first blade 310, but when the height h2 of the second blade 320 is too high, the second blade 320 may apply a heavy load to the motor. The high load applied to the motor may drop the power of the motor, leading to a drop in force of the second blade 320 to strike the foreign materials. Furthermore, the too high height h2 of the second blade 320 may cause significant noise and vibration when the cleaner 1 is used on a hard surface to be cleaned. Accordingly, it is desirable that the height h2 of the second blade 320 is as high as to be able to strike the foreign materials but as not to apply too much load to the motor. The first height h1 of the first blade 310 may be 6.70±0.30 mm, and the second height h2 of the second blade 320 may be 7.0±0.05 mm.

The mass compensation rib 500 may have a square-shaped cross-section. However, it is not limited thereto.

Experimental results that show a reduction in vibration and noise of the cleaner 1 due to the mass compensation rib 500 added to the drum module 200 will now be described.

Experiments were conducted on the cleaner 1 driven on a Wilton carpet surface to be cleaned with a certain amount of objects corresponding to foreign materials laid thereon.

In the table provided below, Max, Mid, and Min were classified according to an amount of power applied to the motor 141. In this case, the experiment was conducted with Max of 200 W, Mid of 40 W, and Min of 18 W.

Figure 10:
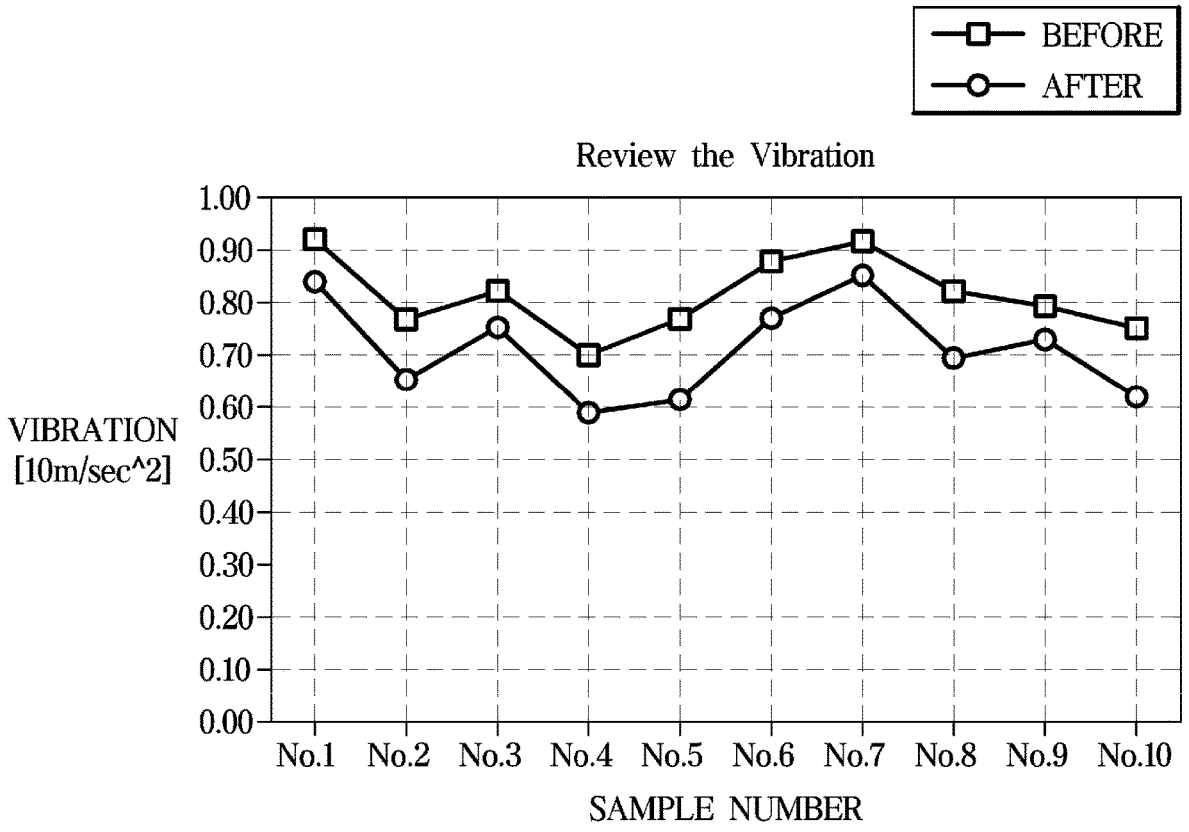
FIG. 10 is a graph summarizing experiment for measuring vibration values before and after a mass compensation member is added to the cleaner of FIG. 1.

FIG. 10 is a graph summarizing experiment for measuring vibration values before and after the mass compensation member 500 is added to the cleaner 1 of FIG. 1.

Experimental data on vibration is as follows. The vibration value is denoted by a value resulting from a measured vibration value divided by acceleration of gravity.

First, Table 1 below represents experimental data on vibration values of the cleaner 1 without the mass compensation rib 500 added thereto.

TABLE 1

| No | Max | Mid | Min |
|---|---|---|---|
| #1 | 0.55 | 0.63 | 1.11 |
| #2 | 0.52 | 0.52 | 1.08 |
| #3 | 0.58 | 0.55 | 1.08 |
| #4 | 0.46 | 0.56 | 1.06 |
| #5 | 0.53 | 0.54 | 1.12 |
| #6 | 0.64 | 0.62 | 1.15 |
| #7 | 0.60 | 0.54 | 1.21 |
| #8 | 0.63 | 0.75 | 1.35 |
| #9 | 0.59 | 0.62 | 1.12 |
| #10 | 0.66 | 0.71 | 1.14 |

Table 2 below represents experimental data on vibration values of the cleaner 1 with the mass compensation rib 500 added thereto.

TABLE 2

| No | Max | Mid | Min |
|---|---|---|---|
| #1 | 0.34 | 0.54 | 0.92 |
| #2 | 0.49 | 0.46 | 0.95 |

TABLE 2-continued

| No | Max | Mid | Min |
|---|---|---|---|
| #3 | 0.52 | 0.50 | 0.96 |
| #4 | 0.47 | 0.48 | 1.00 |
| #5 | 0.42 | 0.61 | 1.05 |
| #6 | 0.44 | 0.51 | 0.94 |
| #7 | 0.49 | 0.56 | 1.02 |
| #8 | 0.51 | 0.55 | 0.98 |
| #9 | 0.52 | 0.58 | 0.94 |
| #10 | 0.46 | 0.52 | 0.89 |

FIG. 10 is a graph resulting from extracting only Min values from among the experimental data of Table 1 and Table 2.

As shown in FIG. 10, vibration values were further reduced for a test sample with the mass compensation rib 500 added thereto than any test sample without the mass compensation rib 500 added thereto.

Figure 11:
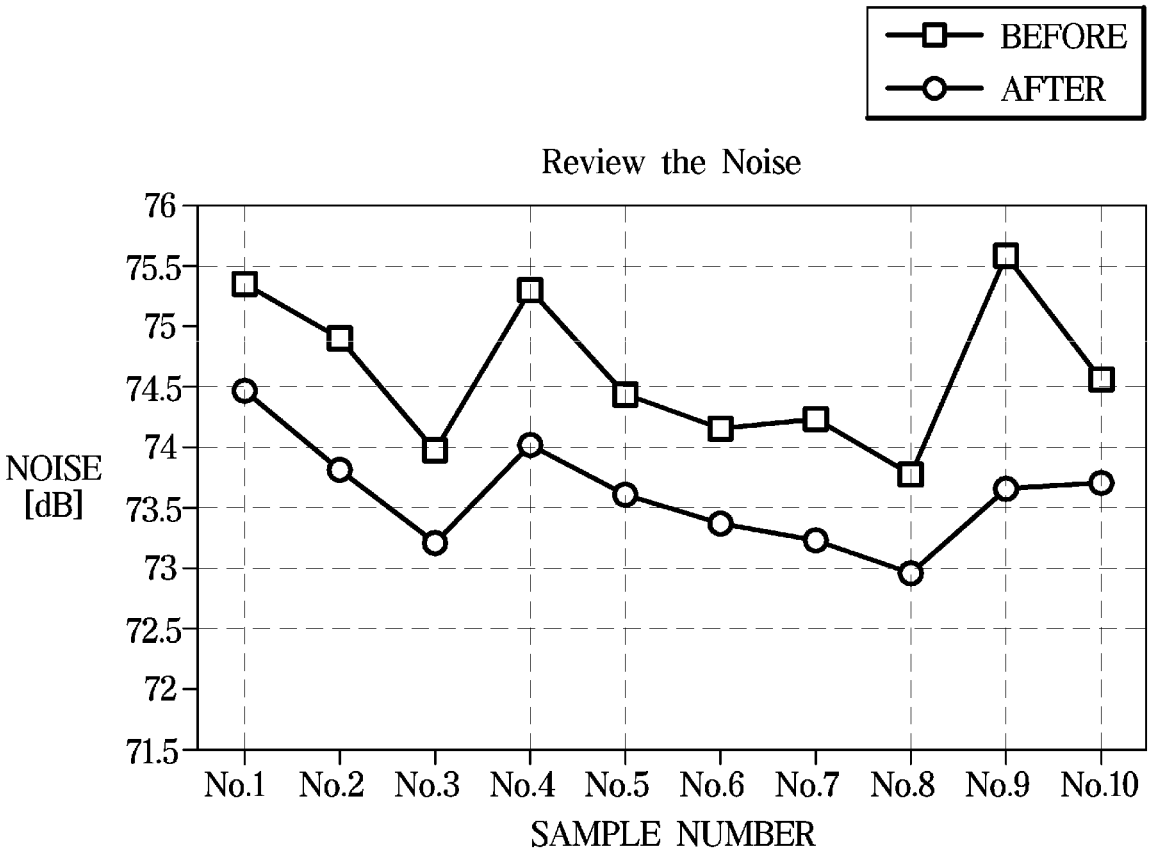
FIG. 11 is a graph summarizing experimental noise values before and after a mass compensation member is added to the cleaner of FIG. 1.

FIG. 11 is a graph summarizing experimental noise values before and after the mass compensation member 500 is added to the cleaner 1 of FIG. 1.

Experimental data on noise is as follows. Noise values were measured in dB.

First, Table 3 below represents experimental data on noise values of the cleaner 1 without the mass compensation rib 500 added thereto.

TABLE 3

| No | Max | Mid | Min |
|---|---|---|---|
| #1 | 83.50 | 77.37 | 75.36 |
| #2 | 81.80 | 76.58 | 74.91 |
| #3 | 81.06 | 76.67 | 73.99 |
| #4 | 83.48 | 77.23 | 75.31 |
| #5 | 81.01 | 76.77 | 74.45 |
| #6 | 81.09 | 76.75 | 74.17 |
| #7 | 80.88 | 76.45 | 74.24 |
| #8 | 82.58 | 76.62 | 73.79 |
| #9 | 81.57 | 77.69 | 75.60 |
| #10 | 82.40 | 77.10 | 74.59 |

Table 4 below represents experimental data on noise values of the cleaner 1 with the mass compensation rib 500 added thereto.

TABLE 4

| No | Max | Mid | Min |
|---|---|---|---|
| #1 | 82.20 | 76.15 | 74.28 |
| #2 | 81.00 | 75.44 | 73.77 |
| #3 | 80.34 | 75.32 | 73.15 |
| #4 | 82.14 | 76.11 | 73.98 |
| #5 | 80.45 | 75.49 | 73.72 |
| #6 | 80.59 | 75.32 | 73.34 |
| #7 | 80.11 | 75.55 | 73.11 |
| #8 | 81.32 | 75.28 | 72.66 |
| #9 | 80.47 | 76.47 | 74.38 |
| #10 | 81.18 | 76.08 | 73.23 |

FIG. 11 is a graph resulting from extracting only Min values from among the experimental data of Table 3 and Table 4.

As shown in FIG. 11, noise values were further reduced for a test sample with the mass compensation rib 500 added thereto than any test sample without the mass compensation rib 500 added thereto.

Various embodiments of the disclosure will now be described. Descriptions about what are overlapped with those as described above will not be repeated.

The first blade 310 and the second blade 320 have thus far been used to describe the disclosure. The disclosure will now be described on the assumption that the blade 300 includes the third blade 330*a*, 330*b*, 330*c*, 330*d*, 330*e*, 330*f*, 330*g* having a mass less than the mass of the second blade 320. Although the third blade 330*a*, 330*b*, 330*c*, 330*d*, 330*e*, 330*f*, 330*g* has the mass less than the mass of the second blade 320, the mass may be greater or less than the mass of the first blade 310.

The supporting rib 400 arranged to be adjacent to the first blade 310 may be called the first supporting rib 420. The supporting rib 400 arranged to be adjacent to the second blade 320 may be called the second supporting rib 430. The supporting rib 400 arranged to be adjacent to the third blade 330*a*, 330*b*, 330*c*, 330*d*, 330*e*, 330*f*, 330*g* may be called the third supporting rib 440*a*, 440*b*, 440*c*, 440*d*, 440*e*, 440*f*, 440*g*.

The mass compensation rib 500 arranged to be adjacent to the first blade 310*a*, 330*b*, 330*c*, 330*d*, 330*e*, 330*f*, 330*g* may be called a first mass compensation rib 510*a*, 510*g*. The mass compensation rib arranged to be adjacent to the third blade 330*a*, 330*b*, 330*c*, 330*d*, 330*e*, 330*f*, 330*g* may be called a second mass compensation rib 520*a*, 520*g*.

Various embodiments will now be described.

Figure 12:
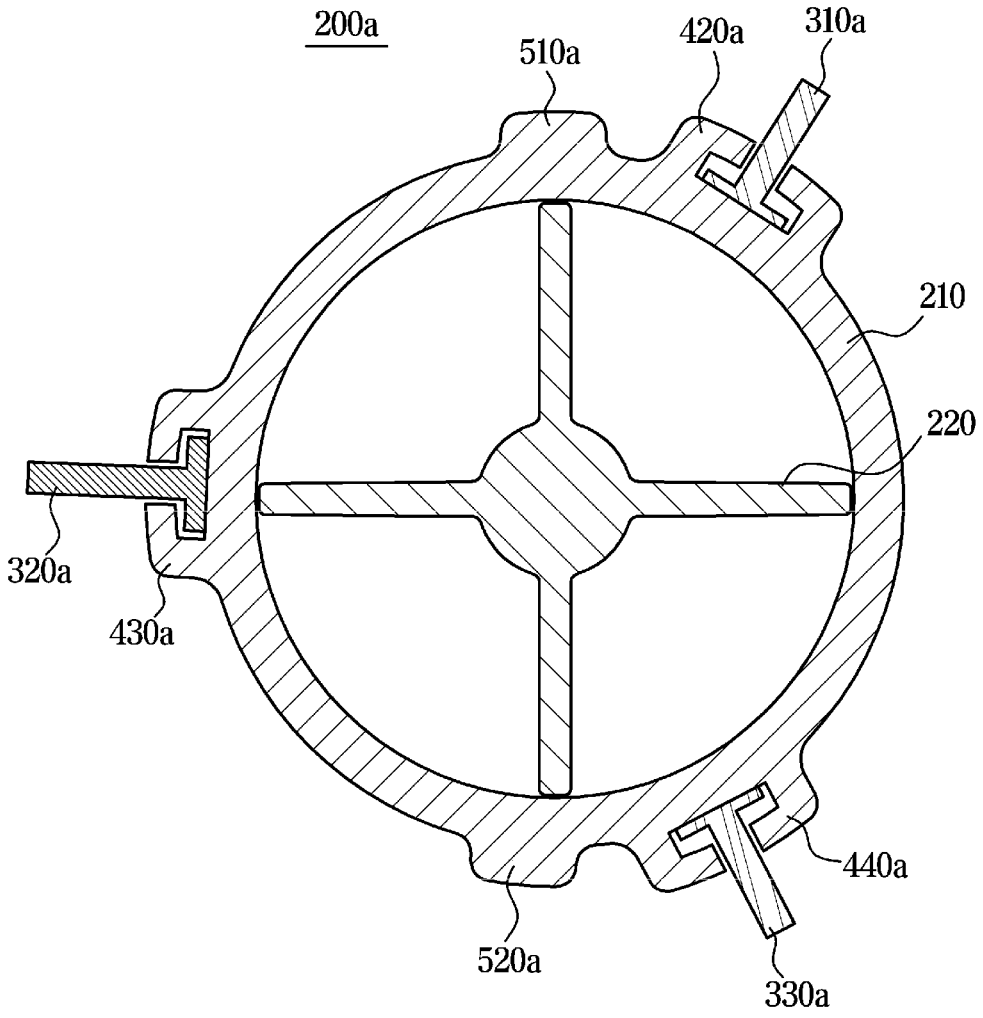
FIG. 12 is a cross-sectional view of a drum module, according to another embodiment of the disclosure.

FIG. 12 is a cross-sectional view of a drum module 200*a*, according to another embodiment of the disclosure.

As shown in FIG. 12, the mass compensation rib 500 may be provided to be separated from the supporting rib 400.

Specifically, a first mass compensation rib 510*a* may be provided to be separated from a first supporting rib 420*a*, and a second mass compensation rib 520*a* may be provided to be separated from the third supporting rib 440*a*.

In this case, a second blade 320*a* may have a greater mass than a first blade 310*a* and a third blade 330*a*, so that the first mass compensation rib 510*a* located between a first blade 310*a* and the second blade 320*a* may be closer to the first blade 310*a* in the circumferential direction of the drum body 210. Similarly, the second mass compensation rib 520*a* located between the third blade 330*a* and the second blade 320*a* may be closer to the third blade 330*a* in the circumferential direction of the drum body 210.

This may make the mass center M closer to the rotation center R, thereby reducing vibration and noise occurring when the cleaner 1 is operated.

Figure 13:
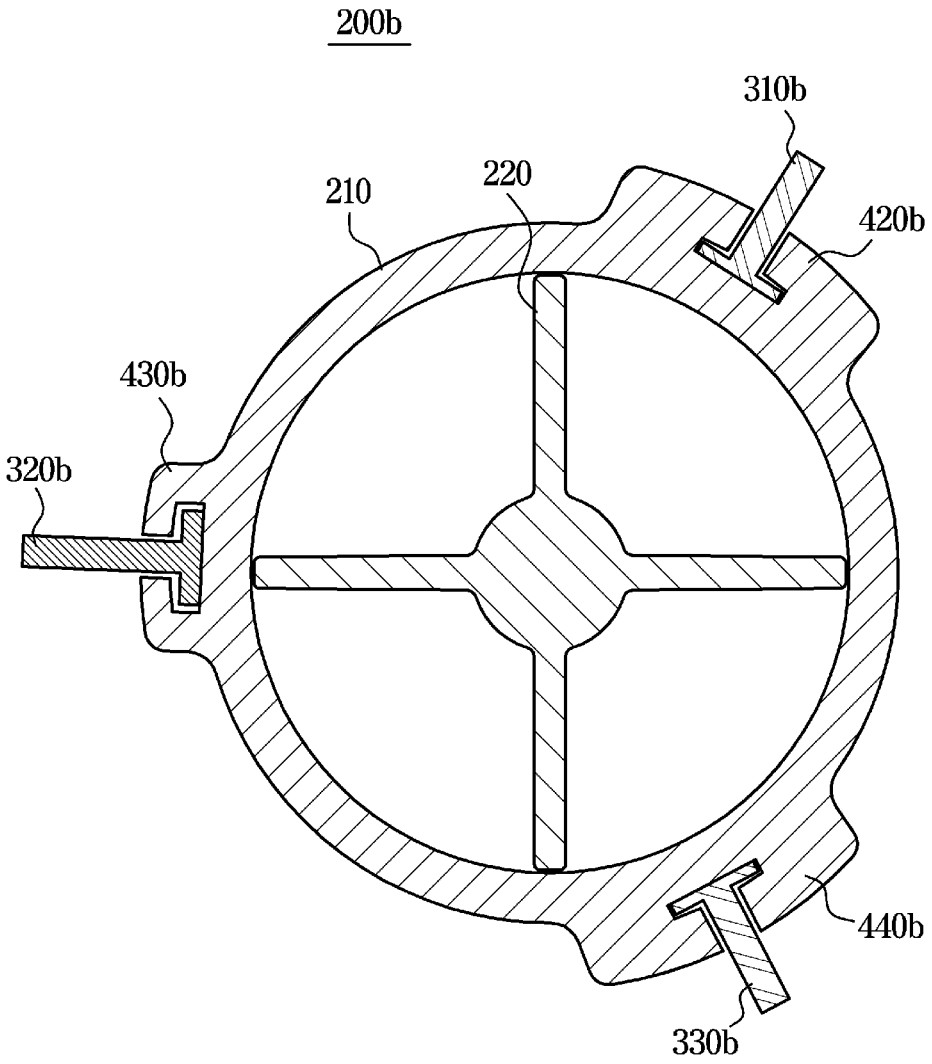
FIG. 13 is a cross-sectional view of a drum module, according to still another embodiment of the disclosure.

FIG. 13 is a cross-sectional view of a drum module 200*b*, according to still another embodiment of the disclosure.

As shown in FIG. 13, a supporting rib 420*b* may perform a mass compensation function.

The first supporting rib 420*b* may have a mass greater than a second supporting rib 430*b*. A third supporting rib 440*b* may have a mass greater than the second supporting rib 430*b*. Differences in mass between a second blade 320*b* and a first blade 310*b* and between the second blade 320*b* and a third blade 330*b* may be compensated for by the first supporting rib 420*b* and the third supporting rib 440*b*.

This may make the mass center M closer to the rotation center R, thereby reducing vibration and noise occurring when the cleaner 1 is operated.

In FIG. 13, in a way of making the first supporting rib 420*b* and the third supporting rib 440*b* have larger volumes than the second supporting rib 430*b*, the masses become greater. It is not, however, limited to the shapes or ways, and may be attained by having different shapes or using high-dense materials.

Figure 14:
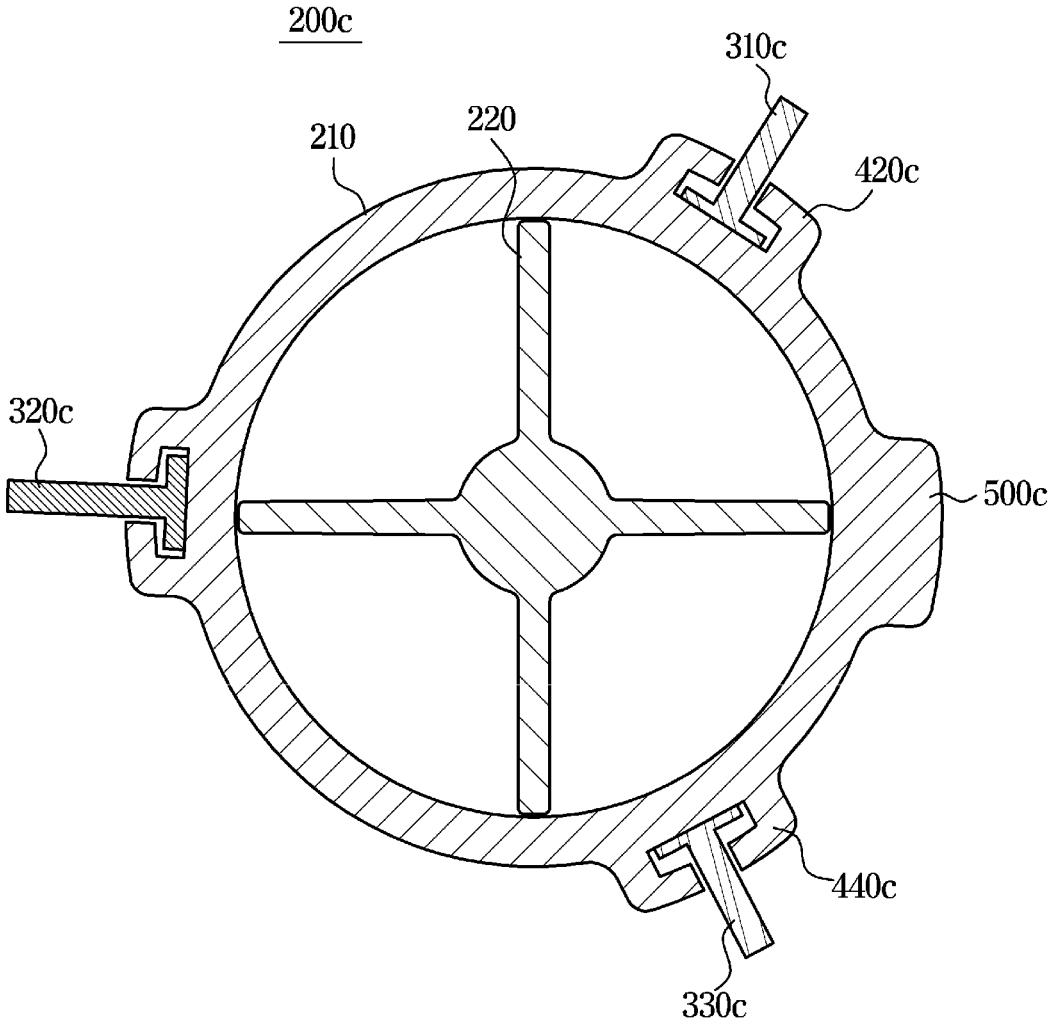
FIG. 14 is a cross-sectional view of a drum module, according to still another embodiment of the disclosure.

FIG. 14 is a cross-sectional view of a drum module 200*c*, according to still another embodiment of the disclosure.

As shown in FIG. 14, a mass compensation rib 500*c* may be arranged between a first blade 310*c* and a third blade 330*c* in the circumferential direction of the drum body 210.

In other words, the mass compensation rib 500*c* may be arranged to face the second blade 320*c* with the rotation shaft of the drum body 210 in between.

The second blade 320*c* may have a mass greater than that of the first blade 310*c* and that of the third blade 330*c*, making the mass center M closer to the rotation center R, thereby reducing vibration and noise occurring when the cleaner 1 is operated.

Figure 15:
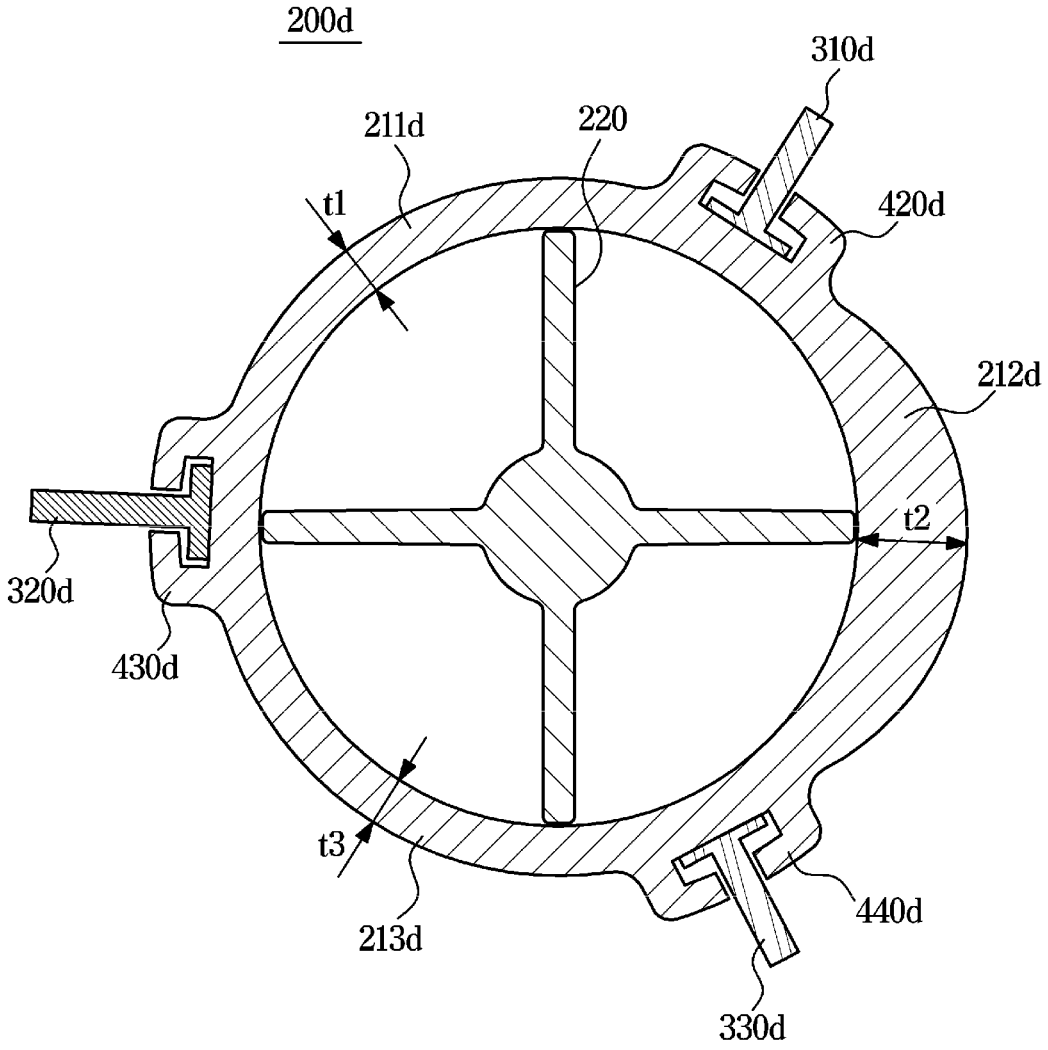
FIG. 15 is a cross-sectional view of a drum module, according to still another embodiment of the disclosure.

FIG. 15 is a cross-sectional view of a drum module 200*d*, according to still another embodiment of the disclosure.

As shown in FIG. 15, a side of the drum body 210 may perform a mass compensation function.

The drum body 210 may include a first thickness portion 211*d* formed between a first supporting rib 420*d* and a second supporting rib 430*d*. The drum body 210 may include a second thickness portion 212*d* formed between a third supporting rib 440*d* and the first supporting rib 420*d*. The drum body 210 may include a third thickness portion 213*d* formed between the second supporting rib 430*d* and the third supporting rib 440*d*.

Thickness of the first thickness portion 211*d* is called first thickness t1. Thickness of the second thickness portion 212*d* is called second thickness t2. Thickness of the third thickness portion 213*d* is called third thickness t3.

In this case, mass compensation may be made by having the second thickness t2 thicker than the first thickness t1 and the third thickness t3.

The second blade 320*d* may have a mass greater than that of the first blade 310*d* and that of the third blade 330*d*, making the mass center M closer to the rotation center R, thereby reducing vibration and noise occurring when the cleaner 1 is operated.

Although a change in mass is made using thicknesses of the drum body 210 in the embodiment, a difference in material may be used to make the change in mass in each portion of the drum body 210. This may compensate for the mass eccentricity.

Figure 16:
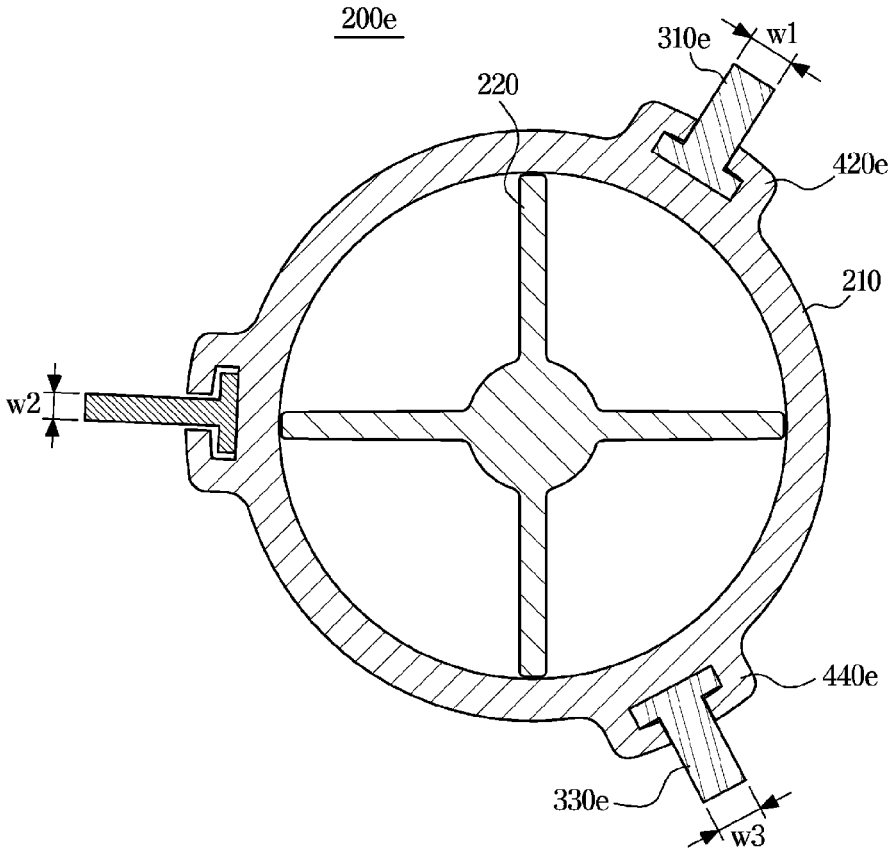
FIG. 16 is a cross-sectional view of a drum module, according to still another embodiment of the disclosure.

FIG. 16 is a cross-sectional view of a drum module 200*e*, according to still another embodiment of the disclosure.

As shown in FIG. 16, a change in width of the first blade 310*e* and the third blade 330*e* may be used to perform the mass compensation function.

Widths of first, second and third blades 310*e*, 320*e*, and 330*e* may be called first width w1, second width w2 and third width w3.

When the second blade 320*e* is formed with a denser material than that of the first blade 310*e* and that of the third blade 330*e*, mass compensation is attained by having the first width w1 larger than the second width w2 and having the third width w3 larger than the second width w2.

This may make the mass center M closer to the rotation center R, thereby reducing vibration and noise occurring when the cleaner 1 is operated.

Figure 17:
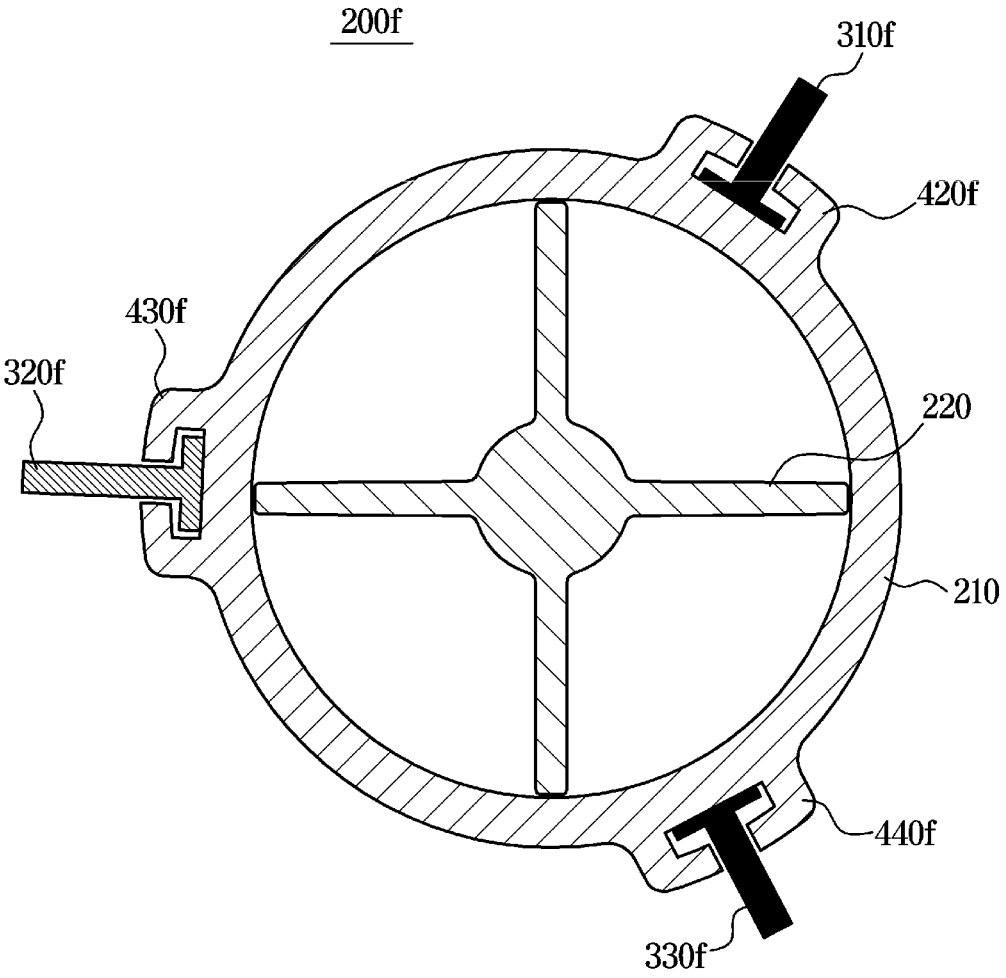
FIG. 17 is a cross-sectional view of a drum module, according to still another embodiment of the disclosure.

FIG. 17 is a cross-sectional view of a drum module 200*f*, according to still another embodiment of the disclosure.

As shown in FIG. 17, a second blade 320*f* may be formed with a different material than the first blade 310*f* and the third blade 330*f*.

A higher rigid material may be used for the second blade 320*f* than for the first blade 310*f* and the third blade 330*f*. In this case, the first blade 310*f* and the third blade 330*f* may be formed with materials having lower hardness than the second blade 320*f*, and having same or similar density to the second blade 320*f*.

Such a selection of material may enable the mass compensation function.

Figure 18:
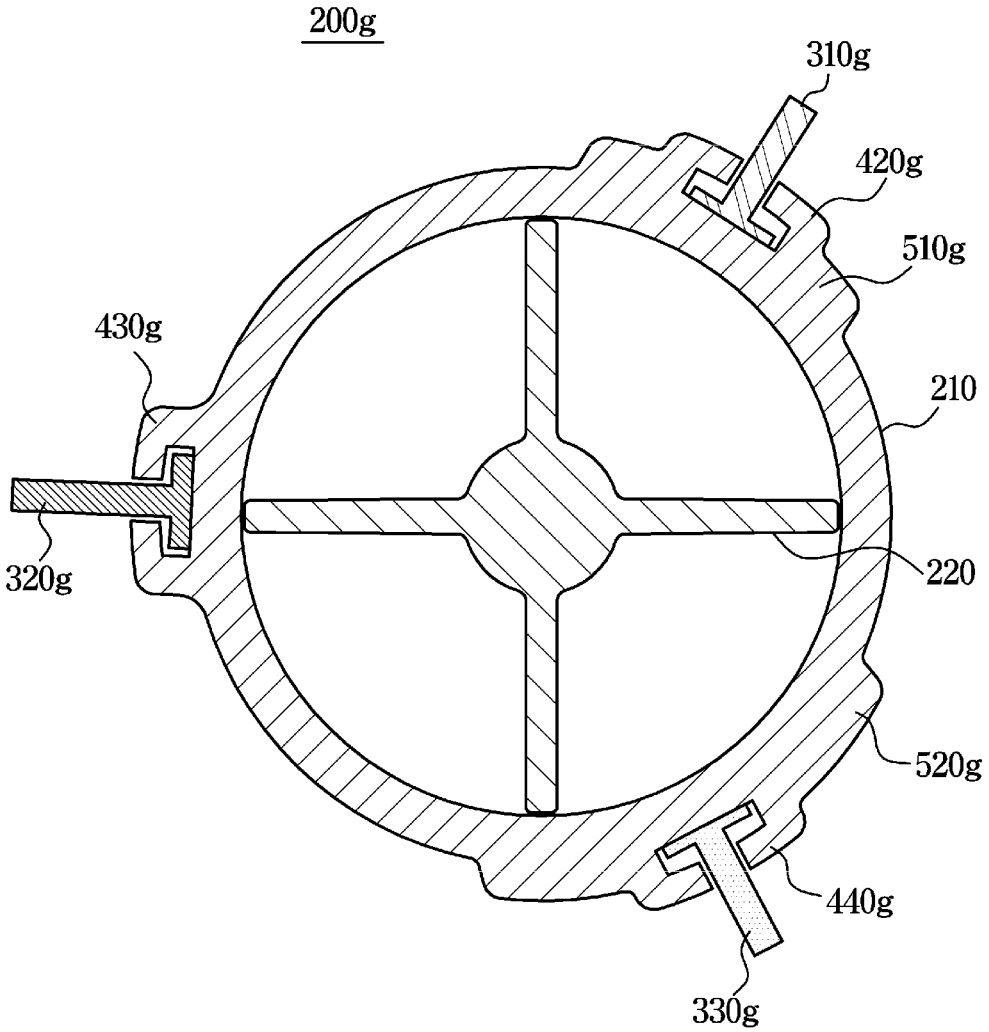
FIG. 18 is a cross-sectional view of a drum module, according to still another embodiment of the disclosure.

FIG. 18 is a cross-sectional view of a drum module 200*g*, according to still another embodiment of the disclosure.

As shown in FIG. 18, a third blade 330*g* may be formed to have a mass less than a first blade 310*g*.

In this case, a first mass compensation rib 510*g* may have a mass less than a second compensation rib 520*g*. It is because, based on the relation with the second blade 320*g*, mass eccentricity formed by the first blade 310*g* is less than mass eccentricity formed by the third blade 330*g*.

Accordingly, a first volume of the first mass compensation rib 510*g* may be smaller than a second volume of the second compensation rib 520*g*.

In FIG. 18, the first mass compensation rib 510*g* having a mass less than the second mass compensation rib 520*g* is represented as having a smaller volume. This may also be applied to a case where the second mass compensation rib 520*g* uses denser material than the first mass compensation rib 510*g*.

Figure 19:
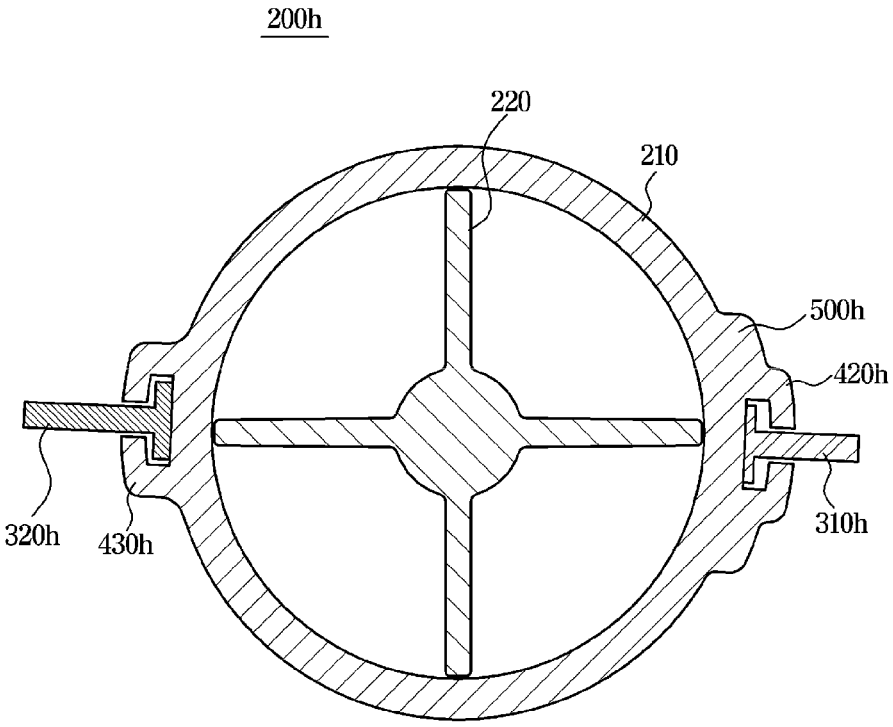
FIG. 19 is a cross-sectional view of a drum module, according to still another embodiment of the disclosure.

FIG. 19 is a cross-sectional view of a drum module 200*h*, according to still another embodiment of the disclosure.

As shown in FIG. 19, there may be two blades 300.

In the case that the number of the blades 300 is two, a single mass compensation rib 500*h* may be arranged to be adjacent to a first blade 310*h*.

It is merely an example showing that the mass compensation rib 500*h* may be formed even on an occasion when the number of the blades 300 is not three, and the number of the blades 300 is not limited thereto.

It has thus far been described that, when there are several blades 300, the blades 300 are arranged at regular intervals. It is not, however, limited thereto, and the blades 300 may be arranged at different intervals.

According to the disclosure, a member for compensating for mass eccentricity occurring in the drum module 200 is added to match the mass center and the rotation center of the drum module 200, thereby reducing noise and vibration of the drum module 200 and the cleaner 1 including the drum module 200.

According to the disclosure, the blades 300 have different materials and shapes to compensate for mass eccentricity occurring in the drum module 200, thereby matching the mass center and the rotation center of the drum module 200 and accordingly, reducing noise and vibration of the drum module 200 and the cleaner 1 including the drum module 200.

Several embodiments of the disclosure have been described above, but a person of ordinary skill in the art will understand and appreciate that various modifications can be made without departing from the scope of the disclosure. Thus, it will be apparent to those or ordinary skill in the art that the true scope of technical protection is only defined by the following claims.

What is claimed is:

1. A cleaner comprising:

a main body; and a suction head connected to the main body to suck foreign objects into the main body therethrough, the suction head comprising:

a housing including a suction port; and a drum module disposed in the housing, and to be rotated to scatter the foreign objects to be sucked through the suction port so that the scattered foreign objects are drawn into the housing through the suction port, the drum module comprising:

a drum body;

a first blade coupled to an outer surface of the drum body;

a second blade separated from the first blade in a circumferential direction of the drum body and having a mass greater than a mass of the first blade; and a mass compensation rib arranged on the outer surface of the drum body to compensate for a difference in mass between the mass of the second blade and the mass of the first blade, wherein the second blade protrudes further than the first blade in a radial direction of the drum body.

2. The cleaner of claim 1, wherein the second blade has a hardness higher than a hardness of the first blade.

3. The cleaner of claim 2, wherein the first blade comprises a nylon material brush, and the second blade comprises a rubber material.

4. The cleaner of claim 1, wherein the mass compensation rib is extending in a longitudinal direction along a length of the first blade.

5. The cleaner of claim 4, wherein the mass compensation rib is formed to have a length corresponding to the length of the first blade.

6. The cleaner of claim 5, wherein the first blade is formed in a spiral shape along the outer surface of the drum body, and the mass compensation rib is formed in a spiral shape on the outer surface of the drum body along the first blade.

7. The cleaner of claim 4, wherein the mass compensation rib is located to be adjacent to the first blade.

8. The cleaner of claim 4, wherein the drum body comprises a supporting rib having an accommodation space to accommodate the first blade, and wherein the mass compensation rib is located to contact the supporting rib.

9. The cleaner of claim 1, wherein the mass compensation rib has a mass to compensate the difference in mass between the first blade and the second blade to make a mass center of the drum module closer to a rotation center of the drum module.

10. The cleaner of claim 1, wherein the mass compensation rib is a first mass compensation rib located to be adjacent to the first blade, and wherein the drum module comprises:

a third blade separated from the first blade and the second blade in the circumferential direction of the drum body and having a less mass than the second blade; and a second mass compensation rib located to be adjacent to the third blade.

11. The cleaner of claim 1, wherein the drum module comprises:

a third blade configured to be separated from the first blade and the second blade in the circumferential direction of the drum body and having a mass less than a mass of the second blade;

a first supporting rib arranged to correspond to a location of the first blade to accommodate the first blade;

a second supporting rib arranged to correspond to a location of the second blade to accommodate the second blade; and a third supporting rib arranged to correspond to a location of the third blade to accommodate the third blade, and wherein the mass compensation rib is extending in a longitudinal direction of the first blade, the mass compensation rib is a first mass compensation rib located between the first supporting rib and the second supporting rib and formed to be nearer to the first supporting rib in the circumferential direction, and the mass compensation rib further comprises a second mass compensation rib located between the second supporting rib and the third supporting rib and formed to be nearer to the third supporting rib in the circumferential direction.

12. The cleaner of claim 1, wherein the drum module comprises:

a third blade configured to be separated from the first blade and the second blade in the circumferential direction of the drum body and having a mass less than a mass of the second blade;

a first supporting rib arranged to correspond to a location of the first blade to accommodate the first blade;

a second supporting rib arranged to correspond to a location of the second blade to accommodate the second blade; and a third supporting rib arranged to correspond to a location of the third blade to accommodate the third blade, and wherein the mass compensation rib is extending in a longitudinal direction of the first blade and located between the first supporting rib and the third supporting rib.

13. The cleaner of claim 12, wherein the drum body comprises a first thickness portion having first thickness, and the mass compensation rib is a second thickness portion integrally formed with the drum body and having greater thickness than the first thickness portion.

14. The cleaner of claim 1, wherein the drum module further comprises a third blade with a mass less than the mass of the first blade and the mass of the second blade, the mass compensation rib is extending in a longitudinal direction of the first blade, the mass compensation rib is a first mass compensation rib located to be adjacent to the first blade; and the mass compensation rib further comprises a second mass compensation rib located to be adjacent to the third blade and having a mass greater than the first mass compensation rib.

15. A cleaner comprising:

a main body; and a suction head connected to the main body to suck foreign objects into the main body, the suction head comprising:

a housing including a suction port through which the foreign objects are sucked into; and a drum module rotationally coupled to the housing to scatter the foreign objects sucked through the suction port so that the scattered foreign objects are drawn into the housing, and wherein the drum module comprises:

a drum body defining external appearance of the drum module;

a first blade coupled to an outer circumferential surface of the drum body to contact and scatter the foreign objects;

a second blade separated from the first blade in a circumferential direction of the drum body, and having a higher density than a density of the first blade; and a mass compensation rib arranged to be adjacent to the first blade to make a mass center of the drum module closer to a rotation center, wherein the second blade protrudes further than the first blade in a radial direction of the drum body.

16. The cleaner of claim 15, wherein the mass compensation rib has a mass as much as a difference in mass between the first blade and the second blade and extends in a longitudinal direction to make a mass center of the drum module closer to a rotation center of the drum module.

17. The cleaner of claim 15, wherein the mass compensation rib has a square-shaped cross-section.

18. A drum module for cleaner comprising:

a drum body; and a blade coupled to an outer surface of the drum body, the blade comprising:

a first blade;

a second blade having a greater mass than a mass of the first blade; and a mass compensation rib arranged on the outer surface to make a mass center of the drum module closer to a rotation center of the drum module, wherein the second blade protrudes further than the first blade in a radial direction of the drum body.

19. The cleaner of claim 18, wherein the mass compensation rib is extending in a longitudinal direction of the blade and having a length corresponding to a length of the first blade.

* * * * *